United States Patent [19]

Takahashi et al.

[11] Patent Number: 5,057,408

[45] **Date of Patent: * Oct. 15, 1991**

[54] SILVER HALIDE COLOR PHOTOGRAPHIC MATERIALS

[75] Inventors: Osamu Takahashi; Tsumoru Hirano, both of Kanagawa, Japan

[73] Assignee: Fuji Photo Film Co., Ltd., Kanagawa, Japan

[ * ] Notice: The portion of the term of this patent subsequent to Aug. 8, 2006 has been disclaimed.

[21] Appl. No.: 294,701

[22] Filed: Jan. 9, 1989

[30] Foreign Application Priority Data

Jan. 8, 1988 [JP] Japan ..... 63-1247

[51] Int. Cl.[5] ..... G03C 1/08

[52] U.S. Cl. ..... 430/546; 430/551; 430/553

[58] Field of Search ..... 430/505, 512, 545, 546, 430/551, 553

[56] References Cited

U.S. PATENT DOCUMENTS

| | | | |
|---|---|---|---|
| 3,619,195 | 11/1968 | Van Campen | 430/569 |
| 4,239,851 | 12/1980 | Aoki et al. | 430/377 |
| 4,278,757 | 7/1981 | Mukunoki et al. | 430/512 |
| 4,291,113 | 9/1981 | Minamizono et al. | 430/202 |
| 4,368,258 | 1/1983 | Fujiwhara et al. | 430/493 |
| 4,724,197 | 2/1988 | Matejec et al. | 430/377 |
| 4,801,521 | 1/1989 | Ohki et al. | 430/380 |
| 4,840,878 | 6/1989 | Hirose et al. | 430/380 |
| 4,857,449 | 8/1989 | Ogawa et al. | 430/546 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

Disclosed is a silver halide color photographic material comprising a silver halide emulsion layer on a support, wherein said layer contains a dispersion of fine oleophilic grains, which grains contain at least one nondiffusible oil-soluble cyan coupler capable of forming a substantially nondiffusible dye by coupling with the oxidation product of an aromatic primary amine developing agent and at least one coupler solvent which is immiscible with water and has no aromatic group in the molecule and which has a melting point of 100° C. or lower and has a boiling point or decomposition point of 140° C. or higher. As the characteristic feature of the invention, the dispersion of said fine oleophilic grains is formed by emulsifying and dispersing a mixture solution comprising at least one of the coupler, at least one of the coupler solvent and at least one water-insoluble and organic solvent-soluble homopolymer or copolymer. By the combination of the coupler, coupler solvent and polymer, the light fastness and dark fastness of the photographic material is improved. In particular, the stability of the coating composition is improved, and the color balance of the color image formed may be maintained well after being stored even under high temperature and high moisture conditions.

13 Claims, No Drawings

SILVER HALIDE COLOR PHOTOGRAPHIC MATERIALS

FIELD OF THE INVENTION

The present invention relates to silver halide color photographic materials, and in particular, to those which are excellent in terms of the stability of the photographic sensitivity during preparation and storage and of the stability of the color image formed after processing.

BACKGROUND OF THE INVENTION

Color images formed in silver halide color photographic materials are often stored under exposure to light for a long period of time or are sometimes stored in the dark for a long period of time. It is known that the color images often seriously fade, depending upon the storage conditions, which are determined by the wavelength of light as applied thereto and the amount of the light as well as the surrounding heat, moisture and oxygen. In general, the color fading in the former case is called "light-fading" and that in the latter case "dark-fading". When color photographic materials after being processed are stored as recording media for a long period of time, it is desired that the degree of such light-fading or dark-fading is minimized to the least, i.e., the light fastness and the dark fastness are elevated. Additionally, it is desired that the degree of fading, if any, of the respective colors of yellow, magenta and cyan of the color images in the photographic material is well-balanced. However, there is known a disadvantageous phenomenon that the respective colors of yellow, magenta and cyan of photographic color images differ from one another in their degree of light fastness and dark fastness of the respective colors so that, after the color images have been stored for a long period of time, the systematic color balance of the said three colors in the color images is lost and the image quality on the color reproduction and gradation reproduction is thereby be deteriorated.

In general, the degrees of light-fading and dark-fading differ, depending upon the couplers used as well as other various factors. However, with respect to the dark-fading for dyes which have heretofore been used in many color photographic materials, it is known that the color fading is more noticeable in a cyan color image and then a yellow color image and a magenta color image in this order, and in particular, the degree of the dark-fading of a cyan color image is the most noticeable as compared with the other color images.

Under the circumstances, it is believed necessary to suppress the dark-fading of the cyan color image as much as possible, so as to maintain the initial color balance of the three colors of yellow, magenta and cyan in color images, even after the images have been faded by storage for a long period of time. Therefore, various studies have hitherto been made for improvement of the light-fading and dark-fading of color images, especially the cyan color image. The studies may be grouped into the following two areas. One is to develop new couplers capable of forming color images which hardly fade. The other is to develop new additives capable of inhibiting fading of the color images formed.

Many phenol cyan couplers for forming cyan dyes are known. For example, 2-[α-2,4-di-tert-amylphenoxybutanamido]-4,6-dichloro-5-methylphenol described in U.S. Pat. No. 2,801,171 may form a color image with a good light fastness. However, this coupler is known to have a defect in that the heat resistance is poor.

Phenol couplers where the 3- or 5-position of the phenol nucleus is substituted by an alkyl group having 2 or more carbon atoms are described in, for example, U.S. Pat. No. 3,772,002 and JP-A-60-209735 and JP-A-60-205447 (the term "JP-A" as used herein refers to a "published unexamined Japanese patent application"). Although the cyan images formed from these couplers have, to some degree, improved dark fastness, it is known that not only the improvement of the dark fastness is not completely sufficient but also the light fastness is inferior to that of the image obtainable from the aforesaid cyan coupler.

2,5-Diacylaminophenol cyan couplers where the 2- and 5-positions of the phenol nucleus are substituted by acylamino groups are described in, for example, U.S. Pat. Nos. 2,369,929, 2,772,162, 2,895,826, and 4,009,035, JP-A-53-109630 and JP-A-55-163537. These 2,5-diacylaminophenol couplers may form cyan images having an extremely good dark fastness. However, these couplers still have some drawbacks in that the light fastness of the cyan images formed therefrom is far inferior to that formed from the aforesaid two cyan couplers. Further, when these couplers are used in printing photographic materials, the color hue of the color images formed therefrom is somewhat shifted to a shorter wavelength range. In order to compensate for the drawbacks, use of the couplers combined with the aforesaid two cyan couplers has been proposed. However, this is known to cause a noticeable lowering of the dark fastness of the color images obtained.

1-Hydroxy-2-naphthamide cyan couplers are generally insufficient in the light fastness.

The 1-hydroxy-2-acylaminocarbostyryl cyan couplers described in GB Patent 2,068,943 may form color images having good fastness to light and heat, but it has been found that the spectral absorption characteristic of the color images formed is unfavorable for color reproduction of color photographs and the color images formed have pink stains after being exposed to light. Thus, these couplers have been found to have various troublesome problems.

The cyan polymer couplers described in U.S. Pat. No. 3,767,4125, JP-A-59-65844 and JP-A-61-39044 are surely excellent in the dark fastness under a low moisture condition, but these couplers have been found defective in that the dark fastness under a high moisture condition is insufficient.

U.S. Pat. No. 4,203,716 discloses a method of dissolving a hydrophobic substance, such as an oil-soluble coupler in a water-miscible organic solvent and blending the resulting solution with a loadable polymer latex so as to load the hydrophobic substance onto the polymer. However, there is a problem that such a method using a loadable polymer latex is inferior to the case of using a water-immiscible high boiling point organic solvent with respect to the light fastness of the cyan image formed. Moreover, a large amount of a polymer is required to be used in order that the coupler is sufficiently loaded to obtain a sufficient maximum color density. Accordingly, still another defect has been found in the above method, i.e., the cost and the film thickness of the photographic materials have to be elevated because of the use of such excess polymers.

JP-B-48-30494 discloses that photographic materials containing an emulsified dispersion of a coupler formed by the use of a homopolymer of organic solvent-soluble hydrophobic monomers having a particular structure or a copolymer of the said monomers with hydrophilic monomers having a particular structure, in place of using any high boiling point organic solvents, have been improved with respect to the hardness, recoloration failure, light fastness and the storability before processing (the term "JP-B" as used herein refers to an "examined Japanese patent publication"). However, it has been found that the use of such homopolymer of hydrophobic monomers in place of high boiling point organic solvents involves various problems in that the coloring capacity of the coupler is poor. This is especially noticeably when the photographic material is processed with a benzyl alcohol-free developer. Further, the stability of the emulsified dispersion during storage is poor.

In addition, another serious problem has also been found in that when the technique as illustrated in JP-B-48-30494 is applied to a cyan coupler, the light fastness of the color image obtained is far worse than the case using an emulsified dispersion obtained by the use of conventional high boiling point organic solvents.

As mentioned above, the couplers whose dark fastness has been improved by variation of the coupler structures by the prior art techniques are noted to be frequently insufficient in terms of the color hue, coloring capacity, generation of stains and, especially, light fastness. Accordingly, a novel technique capable of overcoming all of the prior art problems and satisfying the necessary points mentioned above is being earnestly desired.

On the other hand, benzyl alcohol is widely used in color development of silver halide color photographic materials using conventional oil-protected couplers in order to elevate the coloring capacity and to shorten the processing time.

However, since benzyl alcohol is hardly soluble in water, solvents such as diethylene glycol, triethylene glycol or alkanolamines are necessary so as to easily dissolve the same. These compounds (solvents) and benzyl alcohol have a high BOD value (biological oxygen demand value) and COD value (chemical oxygen demand value) which mean environmental pollution loads. Therefore, use of such compounds and benzyl alcohol is unfavorable in view of prevention of environmental pollution.

Moreover, use of benzyl alcohol has still another unfavorable problem in that a longer time is required for dissolution of the same even when the said solvents are used.

Further, when benzyl alcohol is brought into a bleaching bath or bleach-fixing bath, a leuco form of a cyan dye is easily formed. This causes lowering of the color density of the images formed In addition, benzyl alcohol often causes retardation of the washing out speed of the development components so that it often has a bad influence on the image storability of the photographic materials processed. For these reasons, it is not better to use benzyl alcohol.

Hence, development of couplers and emulsified dispersions containing the same are being desired for the purpose of attaining improvement of the storability of color images and of attaining excellent coloring capacity of couplers even in the absence of benzyl alcohol.

On the other hand, it has additionally been found that the above-mentioned couplers capable of forming color images with an excellent color fastness, as well as the emulsified dispersions containing the same, often have an action on the silver halide emulsion which affects the photographic sensitivity thereof. That is, it has been found that the use of the aforesaid phenol cyan couplers sometimes causes lowering of the color sensitizing sensitivity in silver halide emulsions and the use of magenta couplers or yellow couplers of some kinds also often causes similar desensitization. The technique of improving color image fastness is desired not to bring such action, and, therefore, development of emulsions which are hardly affected by such action is also desired.

JP-A-51-19534, JP-A-51-110327, JP-A-51-134627, JP-A-52-102722 and JP-A-55-64236 describe the same as in the aforesaid JP-B-48-30494. That is, these references describe examples of using organic solvent-soluble polymers having a particular structure in place of high boiling point organic solvents. In all cases, however, when such polymers were applied to cyan couplers, as opposed to dispersion by the use of conventional high boiling point organic solvents, the following problems occurred.

(1) Couplers easily deposit when these are in the form of an emulsion. (2) The coloring capacity is poor. (3) The light fastness of the color images obtained is poor.

On the other hand, U.S. Pat. No. 4,201,589 describes an example of using dibutyl phthalate as a high boiling point solvent. However, when a high boiling point organic solvent which has an aromatic group in the molecule and which is generally well used is used together with a polymer, a problem has been found in that the amount of the developing agent remaining after processing increases and thus causes stains in the white background part. In addition, there is another problem in the conventional technique in that the property of the coating composition containing both a cyan coupler-containing emulsion and a silver halide emulsion often varies with time after being stored. As a result, the photographic property of the photographic material obtained by coating the said coating composition cannot be kept stable. Against the problem, it has been found in the present invention that the combination of a polymer and a particular high boiling point solvent is effective. On the contrary to this, when a high boiling point solvent having an aromatic group in the molecule, such as dibutyl phthalate, is used, the intended effect cannot be obtained.

SUMMARY OF THE INVENTION

Accordingly, the first object of the present invention is to provide a silver halide color photographic material which has been improved in the light fastness and dark fastness and, in particular, that is capable of forming color images may display an excellent color image storability even under high temperature and high moisture conditions.

The second object of the present invention is to provide a silver halide color photographic material which has been improved in the fading color balance of three colors of yellow, magenta and cyan so that the color reproducibility is not deteriorated even after being stored for a long period of time.

The third object of the present invention is to provide a silver halide color photographic material which may form color images with an improved color image storability, without adversely affecting the photographic characteristics, in particular, without lowering the photographic sensitivity during preparation or storage of the material.

The fourth object of the present invention is to provide a silver halide color photographic material which contains a coupler-emulsified dispersion with an excellent stability and which is excellent in the color image storability; the material displaying a sufficient coloring capacity even when processed with a color developer which does not substantially contain benzyl alcohol.

The fifth object of the present invention is to provide a silver halide color photographic material which has been improved in the dark fastness of the cyan color image to be formed, without deteriorating the light fastness of the said image.

The sixth object of the present invention is to prevent stain in a color photographic material having a coupler polymer-containing emulsified dispersion as processed.

The seventh object of the present invention is to improve the time-dependent stability (storage stability) of a silver halide emulsion in which an emulsified dispersion containing a coupler and a polymer has been dispersed.

It has been found in the present invention that the above-mentioned objects may be attained by provision of a silver halide color photographic material comprising a silver halide emulsion layer on a support, wherein said layer contains a dispersion of fine oleophilic grains, which contain at least one nondiffusible oil-soluble cyan coupler capable of forming a substantially nondiffusible dye by coupling with the oxidation product of an aromatic primary amine developing agent and at least one coupler solvent which is immiscible with water and has no aromatic group in the molecule and which has a melting point of 100° C. or lower and has a boiling point or decomposition point of 140° C. or higher, wherein the dispersion of the said fine oleophilic grains is one obtained by emulsifying and dispersing a mixture solution comprising at least one of said coupler, at least one of said coupler solvent and at least one water-insoluble and organic solvent-soluble homopolymer or copolymer.

DETAILED DESCRIPTION OF THE INVENTION

The present invention will be explained in detail hereinafter.

Cyan couplers which are advantageously used in the present invention are represented by the following formula (I) or (II):

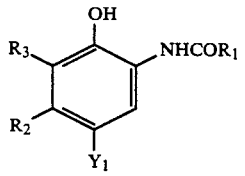

(I)

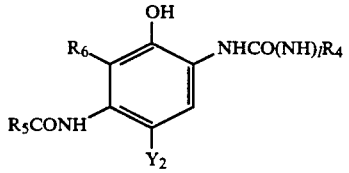

(II)

wherein $R_1$, $R_4$ and $R_5$ each represents a substituted or unsubstituted aliphatic, aromatic or heterocyclic group; $R_3$ and $R_6$ each represents a hydrogen atom, a halogen atom, an aliphatic group, an aromatic group or an acylamino group; or $R_6$ is a nonmetallic atomic group necessary for forming a nitrogen-containing 5-membered or 6-membered ring together with $R_5$; $R_2$ represents a substituted or unsubstituted aliphatic group; $Y_1$ and $Y_2$ each represents a hydrogen atom or a group or atom capable of being released in an oxidative coupling reaction with a developing agent; l represents 0 or 1; and one of the groups $R_2$, $R_3$ and $Y_1$ or one of the groups $R_5$, $R_6$ and $Y_2$ may form a dimer or polymer coupler.

The "aliphatic group" as herein referred to may be linear, branched or cyclic and includes saturated or unsaturated groups such as alkyl, alkenyl and alkynyl groups.

Cyan couplers for use in the present invention, which are represented by the aforesaid formula (I) or (II), will be explained in more detail hereunder.

In formulae (I) and (II), specific examples of the groups for $R_1$, $R_4$ and $R_5$ include an aliphatic group having from 1 to 31 carbon atoms (e.g., methyl, butyl, octyl, tridecyl, isohexyl, cyclohexyl), an aryl group (e.g., phenyl, naphthyl) and a heterocyclic group (e g., 2-pyridyl, 2-thiazolyl, 2-imidazolyl, 2-furyl, 6-quinolyl). These groups may optionally be substituted by one or more substituents selected from an alkyl group, an aryl group, a heterocyclic group, an alkoxy group (e.g., methoxy, 2-methoxyethoxy, tetradecyloxy), an aryloxy group (e.g., 2,4-di-tert-amylphenoxy, 2-chlorophenoxy, 4-cyanophenoxy, 4-butanesulfonamidophenoxy), an acyl group (e.g., acetyl, benzoyl), an ester group (e.g., ethoxycarbonyl, 2,4-di-tert-amylphenoxycarbonyl, acetoxy, benzoyloxy, butoxysulfonyl, toluenesulfonyloxy), an amido group (e.g., acetylamino, butanesulfonamido, dodecylbenzenesulfonamido, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), a sulfonyl group (e.g., methanesulfonyl, carboxymethanesulfonyl, phenylsulfonyl), an aliphatic or aromatic thio group (e.g., butylthio, phenylthio), a hydroxyl group, a cyano group, a carboxyl group, a nitro group, a sulfo group and a halogen atom. If the groups have two or more substituents, the substituents may be the same or different.

The optionally substituted aliphatic group for $R_2$ in formula (II) includes, for example, methyl, ethyl, propyl, butyl, pentadecyl, tert-butyl, cyclohexyl, cyclohexylmethyl, phenylthiomethyl, dodecyloxyphenylthiomethyl, butanamidomethyl and methoxymethyl groups.

In formula (I), $R_3$ may be a hydrogen atom, a halogen atom, a lower alkyl group, an aryl group (e.g., phenyl) or an acylamino group (e.g., acetylamino).

In formula (II), $R_6$ may be a hydrogen atom, a halogen atom, an alkyl group, an aryl group or an acylamino group, or this may be a nonmetallic atomic group necessary for forming a nitrogen-containing 5-membered to 7-membered ring together with $R_5$.

$Y_1$ in formula (I) and $Y_2$ in the formula (II) may be a hydrogen atom or a coupling-releasing group (or atom). Specific examples of the coupling-releasing group (or atom) include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., ethylthio, phenylthio, tetrazolylthio), an imido group (e.g., succinimido, hydantoinyl), and an aromatic azo group (e.g., phenylazo). These releasing groups may optionally contain a photographically useful group.

As cyan couplers, other naphthol cyan couplers may also be used in the present invention. Especially preferred cyan couplers for use in the present invention are couplers of formula (I) where $R_2$ is an ethyl group.

Preferred examples of the oil-soluble cyan couplers for use in the present invention are mentioned below, which, however, are not limitative.

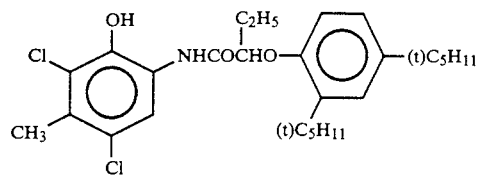

(C-1)

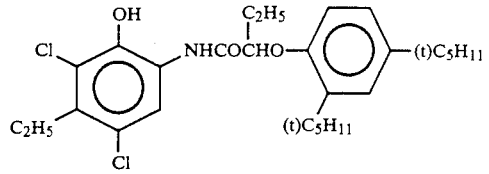

(C-2)

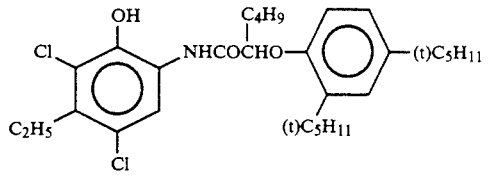

(C-2)

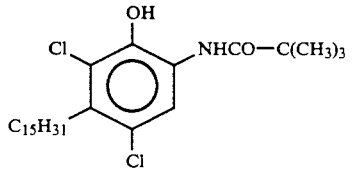

(C-3)

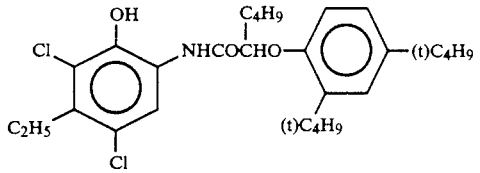

(C-5)

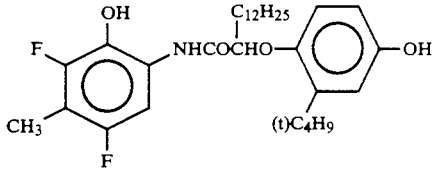

(C-6)

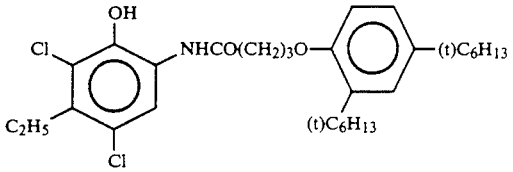

(C-7)

-continued
(C-8)
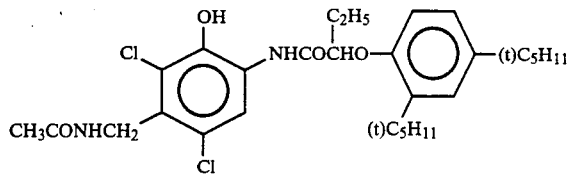
(C-9)
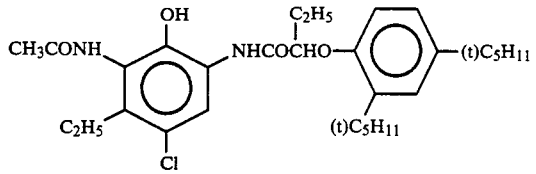
(C-10)
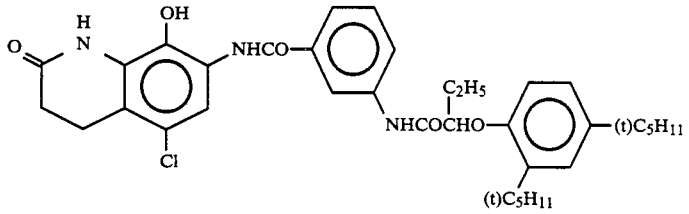
(C-11)
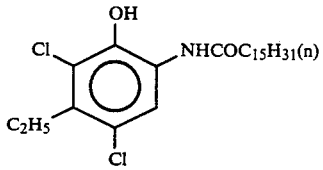
(C-12)
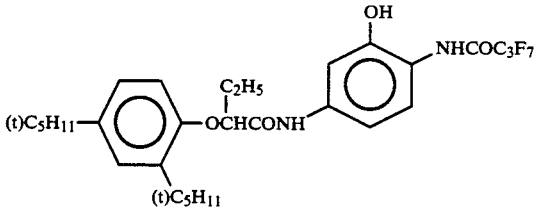
(C-13)
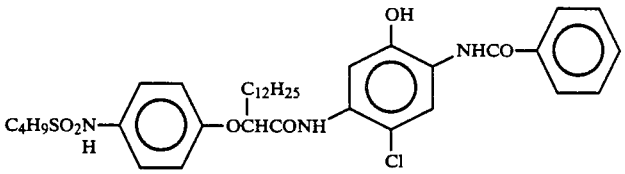
(C-14)
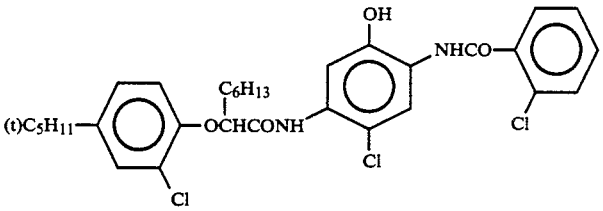
(C-15)
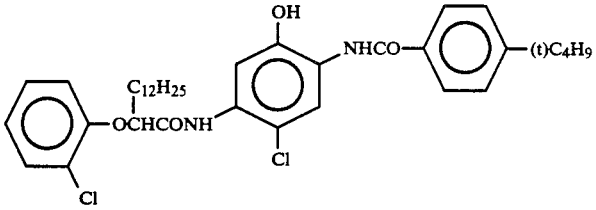

-continued
(C-16)
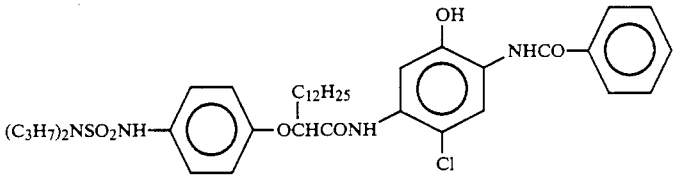
(C-17)
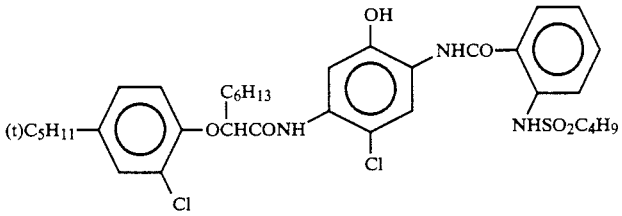
(C-18)
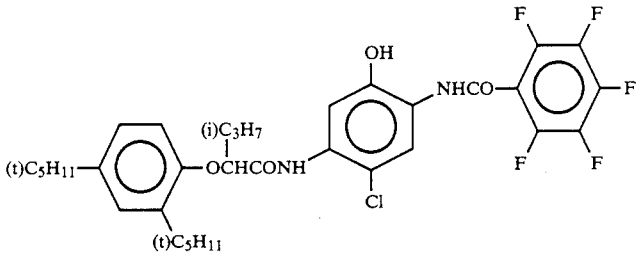
(C-19)
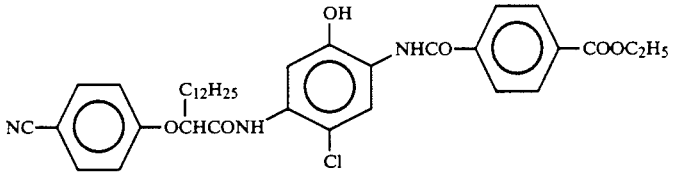
(C-20)
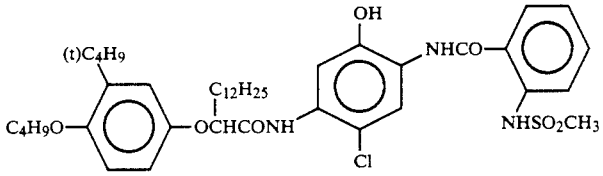
(C-21)
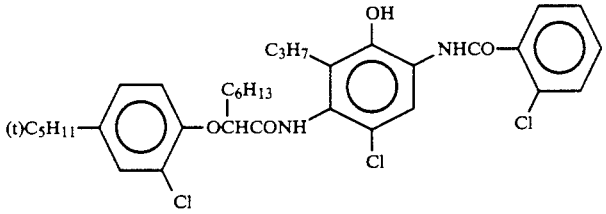
(C-22)
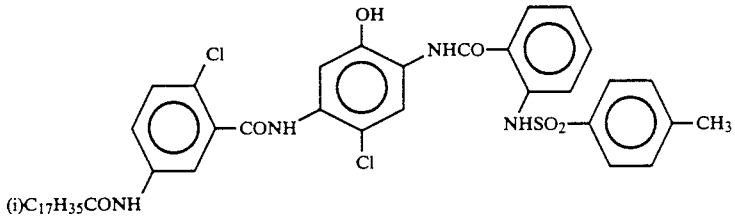

-continued
(C-23)
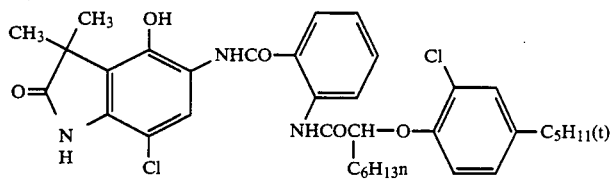
(C-24)
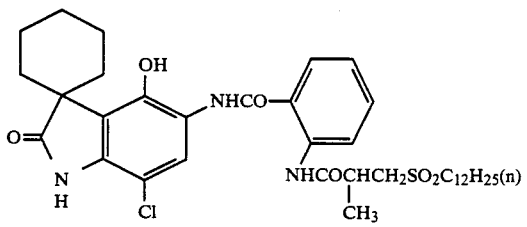
(C-25)
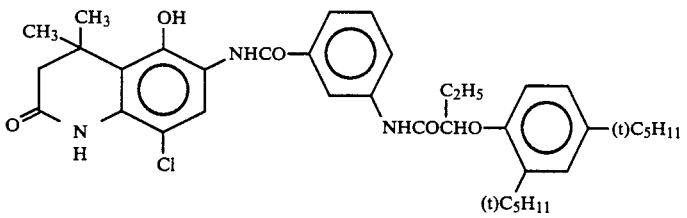
(C-26)
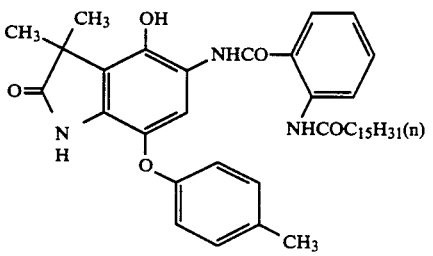
(C-27)
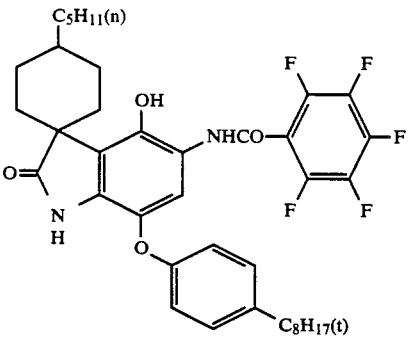
(C-28)
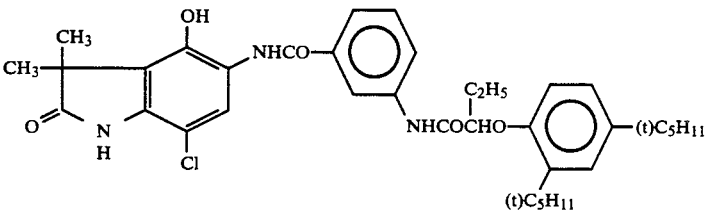

-continued
(C-29)
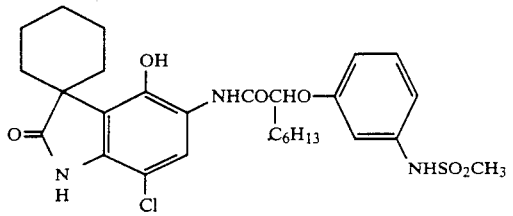
(C-30)
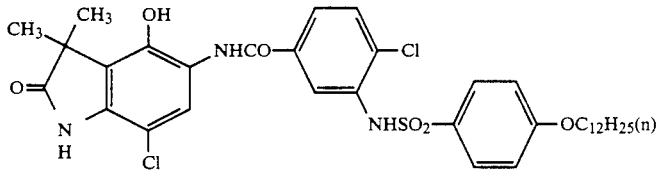
(C-31)
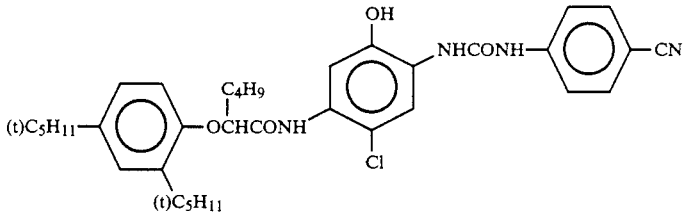
(C-32)
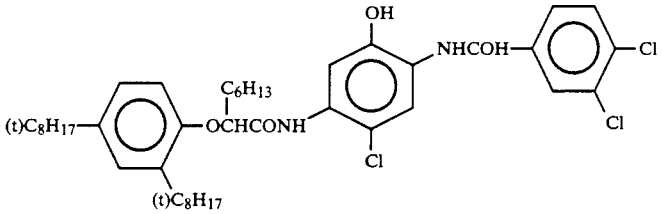
(C-33)
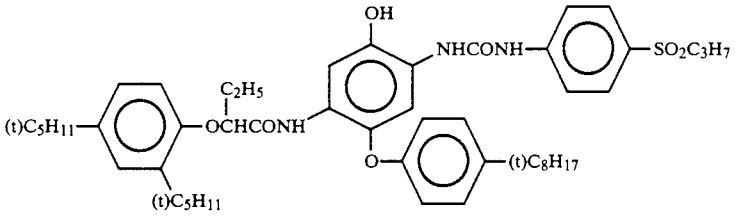
(C-34)
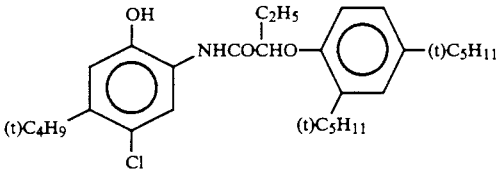
(C-35)
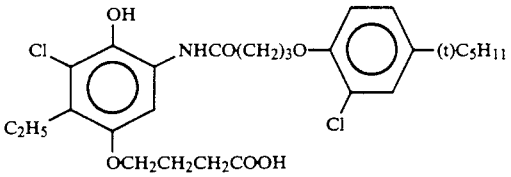

-continued
(C-36)
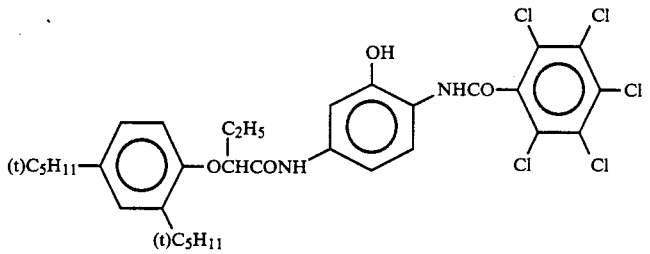
(C-37)
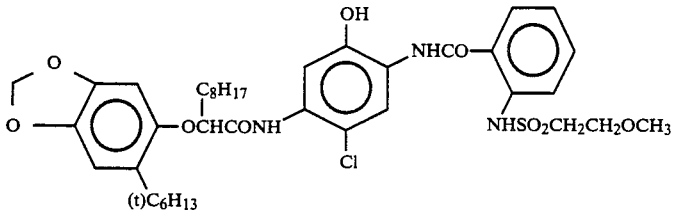
(C-38)
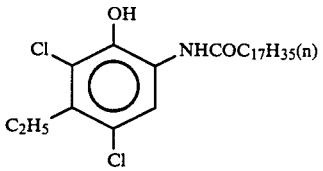
(C-39)
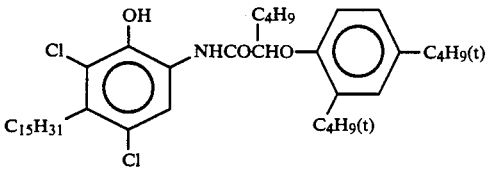
(C-40)
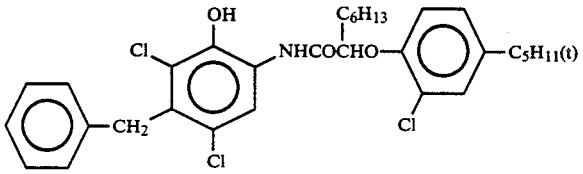
(C-41)
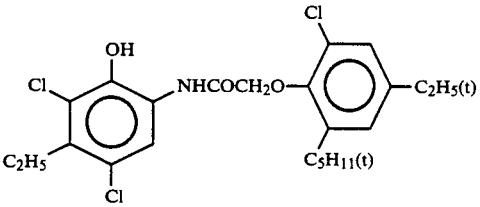
(C-42)
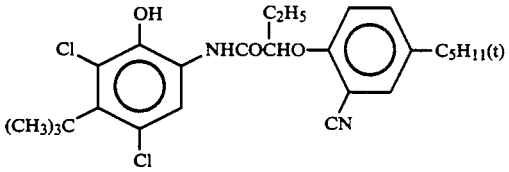
(C-43)
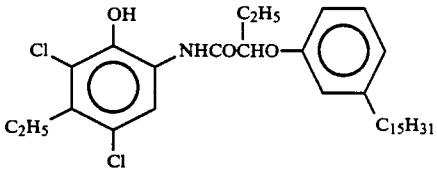

-continued
(C-44)
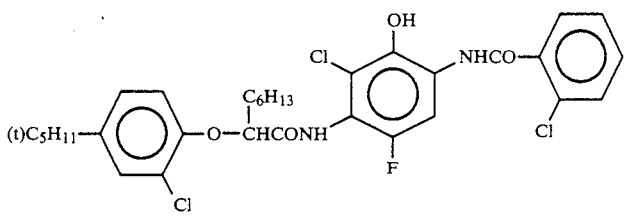
(C-45)
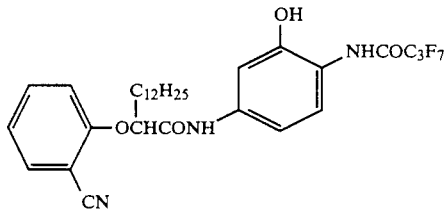
(C-46)
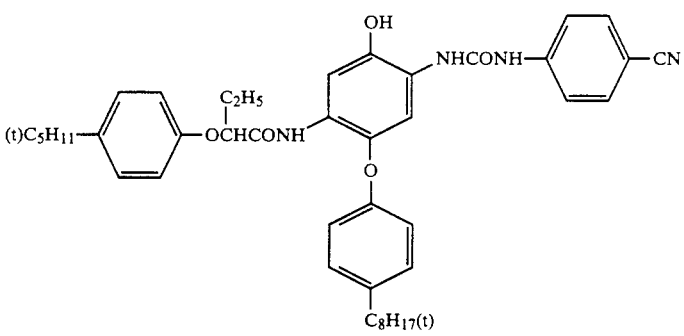
Examples of Naphthol Cyan Couplers
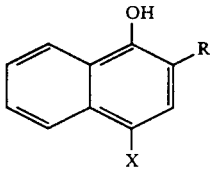
| Compound No. | R | X |
|---|---|---|
| C-47 | 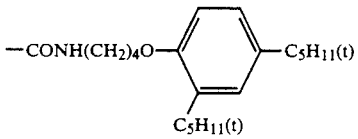 | H |
| C-48 | $-CONH(CH_2)_3O.(CH_2)_{11}CH_3$ | " |
| C-49 | 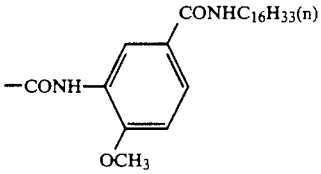 | " |
| C-50 | 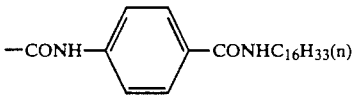 | " |

-continued
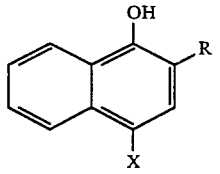
| Compound No. | R | X |
|---|---|---|
| C-51 | 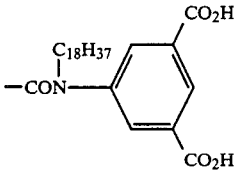 | 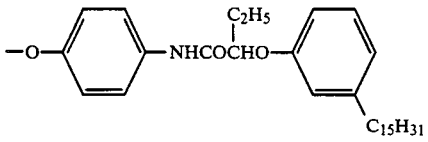 |
| C-52 | 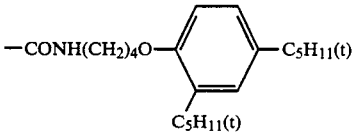 | 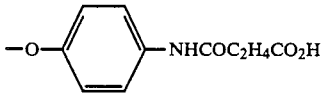 |
| C-53 | $-CONHC_{16}H_{33}$ | $-OC_2H_4SCH_2CO_2H$ |
| C-54 | 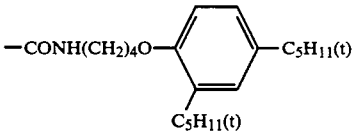 | $-OCH_2CO_2H$ |
| C-55 | " | $-OCH_2CONHCH_2CO_2H$ |
| C-56 | " | $-O(CH_2)_2CONH(CH_2)_2OCH_3$ |
| C-57 | " | $-S(CH_2)_2CO_2H$ |
| C-58 | 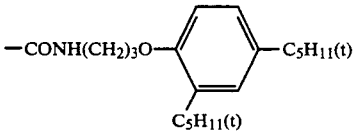 | H |
Examples of 5-Amidonaphthol Cyan Couplers
(C-59)
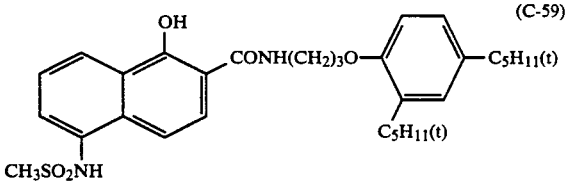
(C-60)
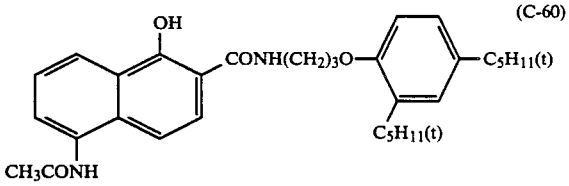
-continued
(C-61)
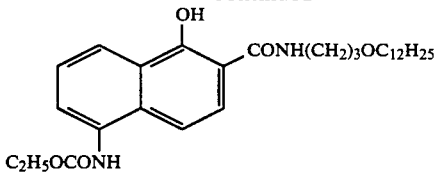
(C-62)
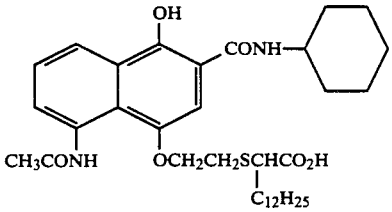

-continued (C-63)

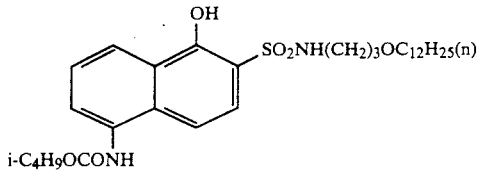

(C-64)

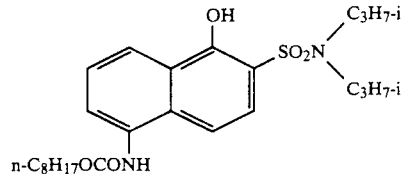

(C-65)

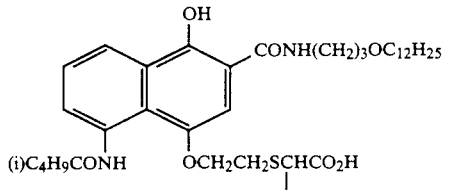

(C-66)

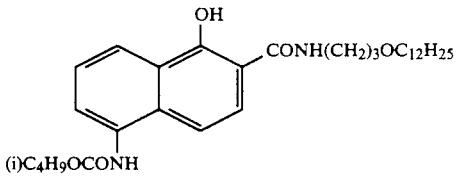

The amount of the cyan coupler to be used is preferably from 1/10 to 1 mol per mol of silver halide.

Coupler solvents which are advantageously used in the present invention in combination with a water-insoluble and organic solvent-soluble polymer are represented by one of the following formulae (III) to (VI).

$$L_1—(COOR_7)_n \quad (III)$$

$$L_2—(OCOR_8)_m \quad (IV)$$

wherein $R_7$ and $R_8$ each represents an aliphatic group; $L_1$ and $L_2$ each represents a 2-valent to 4-valent aliphatic group; n and m each represents an integer of from 2 to 4; and $R_7$ and $R_8$ may be the same or different.

The "aliphatic group" as herein referred to means a linear, branched or cyclic aliphatic hydrocarbon group and includes saturated or unsaturated groups such as alkyl, alkenyl and alkynyl groups. Specific examples of such an aliphatic group are methyl, ethyl, butyl, dodecyl, octadecyl, eicosyl, isopropyl, tert-butyl, tert-octyl, tert-dodecyl, cyclohexyl, cyclopentyl, allyl, vinyl, 2-hexadecenyl and propargyl groups.

$R_7$ and $R_8$ each is preferably an aliphatic group having from 1 to 36 carbon atoms. $L_1$ and $L_2$ each is a 2-valent to 4-valent aliphatic group corresponding to the said monovalent aliphatic group and obtainable therefrom by increasing the number of the valences of the group. Specific examples of the group include an alkylidene group (e.g., methylene, ethylidene, cyclohexylidene), an alkylene group (e.g., ethylene, trimethylene, hexamethylene, undecamethylene, 1,2-cyclohexylene, 1,4-cyclohexylene, 3,8-tricyclo[5,2,1,$0^{2,6}$]decylene) and an alkenylene group (e.g., vinylene, propenylene, 4-cyclohexen-1,2-yl, 2-pentenylene), when n and m are 2; an alkanetriyl group (e.g., 1,2,3-propanetriyl, 2-methylene-1,3-propanediyl, 1,5,8-octanetriyl) and an alkenetriyl group (e.g., 1,2,3-propenetriyl, 2-propen-1,2,4-triyl), when n and m are 3; and an alkanetetrayl group (e.g., 1,2,3,4-butanetetrayl, 1,2-propanediyl-2-ylidene, 2,2-bismethylene-1,3-propanediyl) and an alkenetetrayl group (e.g., 3-octene-1,3,5,8-tetrayl), when n and m are 4.

The number of the total carbon atoms in the molecule composed of $R_7$ and $L_1$ or $R_8$ and $L_2$ is preferably from 12 to 60, more preferably from 16 to 36. n and m are preferably 2 or 3.

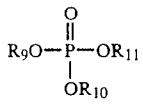

(V)

wherein $R_9$, $R_{10}$ and $R_{11}$ each represents an alkyl group, a substituted alkyl group, a cycloalkyl group, a substituted cycloalkyl group, an alkenyl group or a substituted alkenyl group; and the total of the carbon in the groups $R_9$, $R_{10}$ and $R_{11}$ is preferably from 12 to 60.

The alkyl group for $R_9$, $R_{10}$ and $R_{11}$ in formula (V) includes, for example, butyl, pentyl, hexyl, heptyl, octyl, nonyl, decyl, undecyl, dodecyl, tridecyl, tetradecyl, pentadecyl, hexadecyl and nonadecyl groups.

The alkyl group and alkenyl group may have one or more substituents. Preferably, $R_9$, $R_{10}$ and $R_{11}$ each is an alkyl group, for example, 2-ethylhexyl, n-octyl, 3,5,6-trimethylhexyl, n-nonyl, n-decyl, sec-decyl, sec-dodecyl or tert-octyl group.

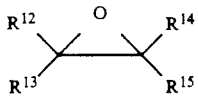

(VI)

wherein $R^{12}$, $R^{13}$, $R^{14}$ and $R^{15}$ each represents, preferably, an alkyl or substituted alkyl group having from 1 to 40 carbon atoms (the substituent for the group being selected from an alkyloxycarbonyl group, an alkylcarbonyloxy group and an alkyloxy group), an alkoxycarbonyl or substituted alkoxycarbonyl group having from 1 to 40 carbon atoms (the substituent for the group being selected from the groups mentioned for the aforesaid substituted alkyl group), or a hydrogen atom. All of $R^{12}$, $R^{13}$, $R^{14}$ and $R^{15}$ must not be hydrogens at the same time. The total of the carbon atoms of $R^{12}$, $R^{13}$, $R^{14}$ and $R^{15}$ is preferably from 8 to 60, more preferably from 8 to 45. $R^{12}$, $R^{13}$, $R^{14}$ and $R^{15}$ may be the same or different and they may form rings. As examples of the rings, there may be mentioned 5-membered or 6-membered alicyclic rings.

The coupler solvents of the present invention may be used as a mixture of two or more kinds of them or may also be used in combination with other conventional aromatic group-having coupler solvents. In the latter case, the proportion of the aromatic group-having coupler solvents is preferably ⅔ by weight or less, more preferably ½ by weight or less, of the total coupler solvent mixture.

The proportion of the coupler solvent of the invention to the coupler is preferably from 0.1 to 3 times by weight, more preferably from 0.3 to 2 times by weight, of the coupler.

Specific examples of the coupler solvents which may be used in the present invention are mentioned below, which, however, are not limitative.
S-1)
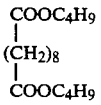
S-2)
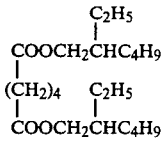
S-3)
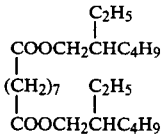
S-4)
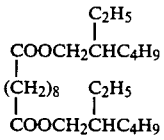
S-5)
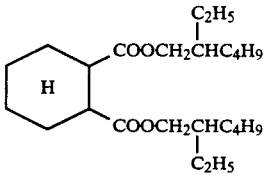
S-6)
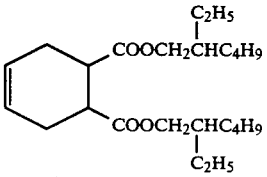
S-7)
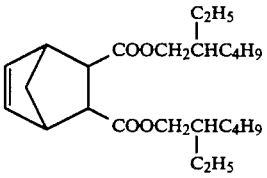
S-8)
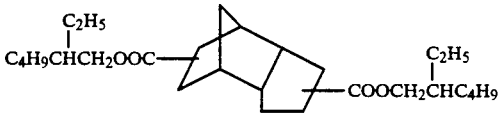
S-9)
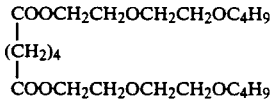
S-10)
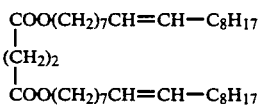
-continued
S-11)
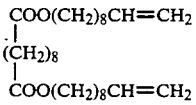
S-12)
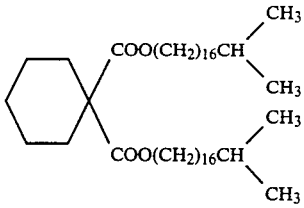
S-13)
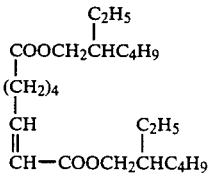
S-14)
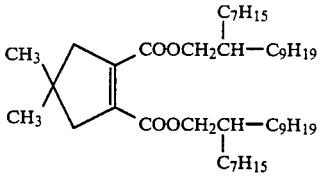
S-15)
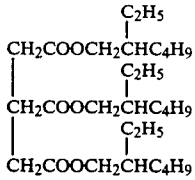
S-16)
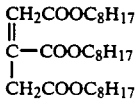
S-17)
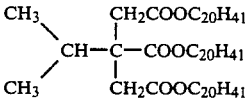
S-18)
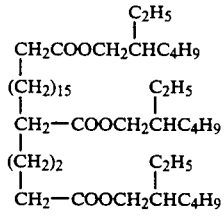
S-19)
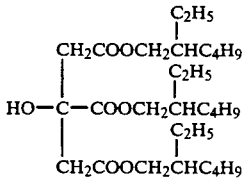
S-20)
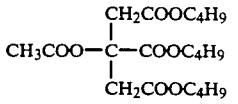

-continued
S-21)
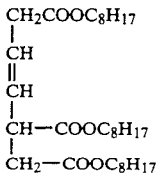
S-22)
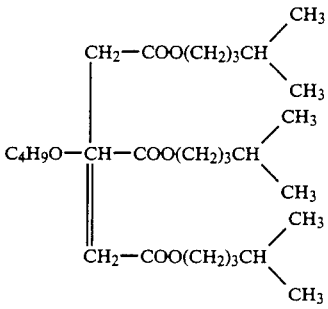
S-23)
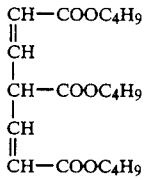
S-24)
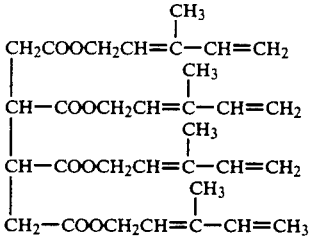
S-25)
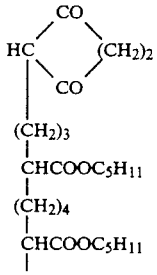
S-26)
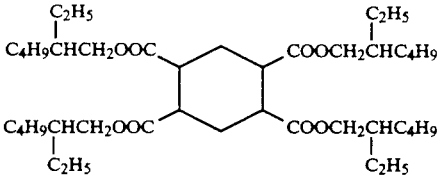
S-27)
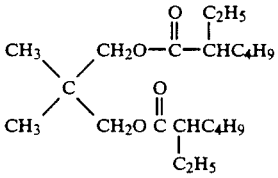
-continued
S-28)
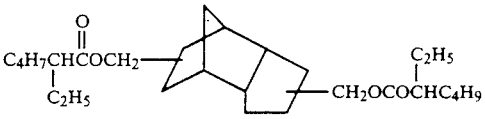
S-29)
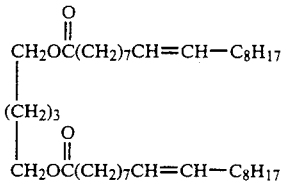
S-30)
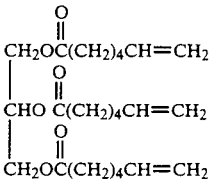
S-31)
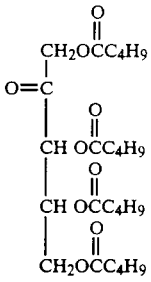
S-32)
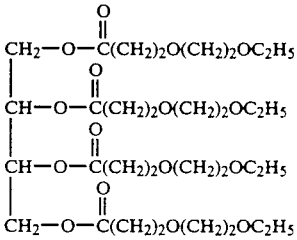
S-33)
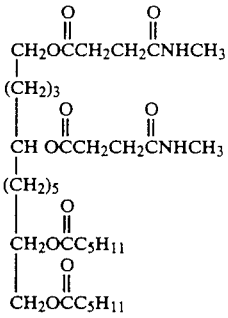
S-34)
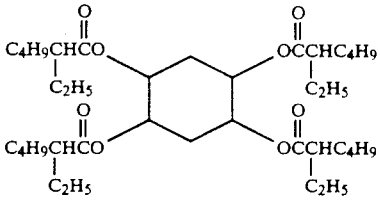

-continued
S-35)
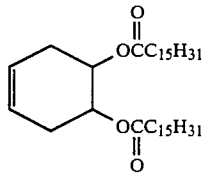
S-36)
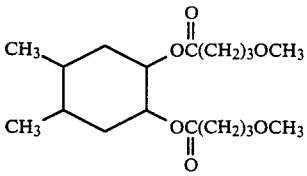
S-37)
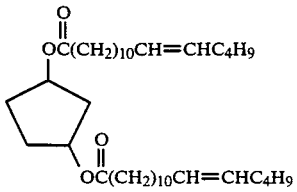
S-38)
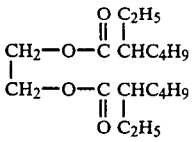
S-39)
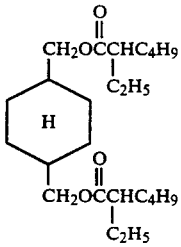
S-40)
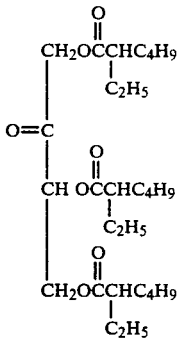
S-41) $O{=}P{\leftarrow}OC_4H_9(n))_3$
S-42) $O{=}P{\leftarrow}OCH_2CH_2CH(CH_3)_3$
S-43) $O{=}P{\leftarrow}OC_6H_{13}(n))_3$
S-44)
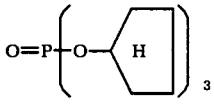
-continued
S-45)
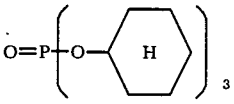
S-46) $O{=}P{\leftarrow}OC_8H_{17}(n))_3$
S-47)
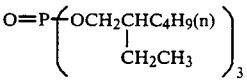
S-48)
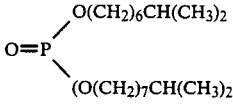
S-49)
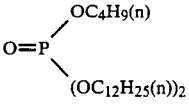
S-50)
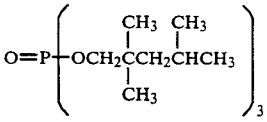
S-51)
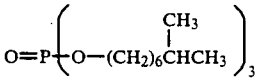
S-52) $O{=}P{\leftarrow}OC_9H_{19}(n))_3$
S-53)
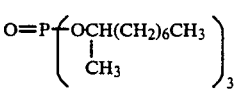
S-54) $O{=}P{\leftarrow}OC_{10}H_{21}(n))_3$
S-55)
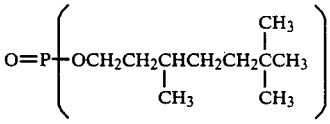
S-56)
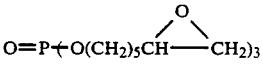
S-57)
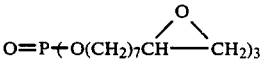
S-58)
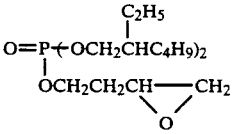
S-59)
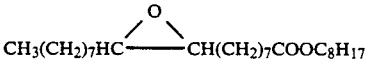
S-60)
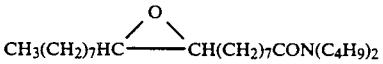
S-61)
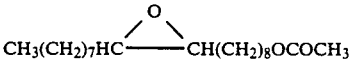

-continued

S-62) 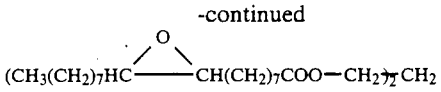

S-63) 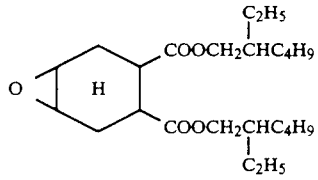

S-64) 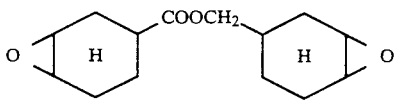

S-65) 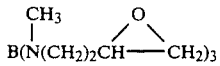

S-66) 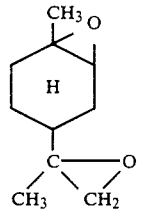

S-67) 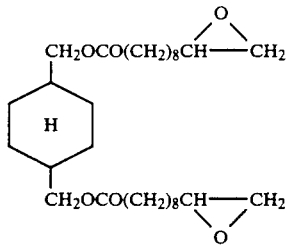

S-68) 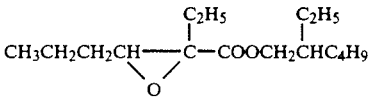

S-69) 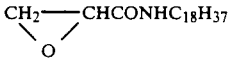

S-70) 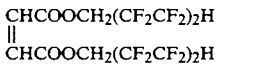

S-71) 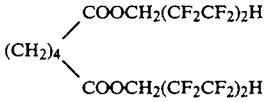

S-72) 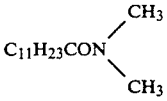

S-73) $CH_2(COOCH_2CH_2OC_4H_9)_2$

S-74) $CH_2(COOC_9H_{19}(iso))_2$

S-75) $CH_2(COOC_{10}H_{21})_2$

Water-insoluble and organic solvent-soluble polymers which are preferably used in the present invention are non-color-forming couplers and more preferably those having a glass transition temperature of 60° C. or higher, especially preferably 90° C. or higher. Preferred polymers are those having relative fluorescence quantum yield, K-value, of 0.2 or more, preferably 0.25 or more, and more preferably 0.3 or more. The polymers having higher K-value are more preferred.

The K-value is a relative fluorescence quantum yield, in polymers, of Compound A having the following structure, Compound A being one of the dyes which are often used as fluorescent probes. The K-value is defined by the following equation.

Compound A

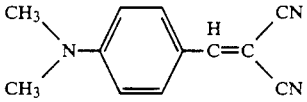

$$K=\phi_a/\phi_b$$

wherein $\phi_a$ and $\phi_b$ are the fluorescence quantum yields of Compound A in polymers a and b, respectively, and determined in accordance with the method described, for example, in *Macromolecules,* 14, 587 (1981).

Specifically, the K-value was calculated using $\phi_a$ and $\phi_b$, which were obtained by measuring at room temperature using thin films of polymers containing Compound A at a concentration of 0.5 mmol/kg (note: the thin films were spin-coated on a slide glass in such a thickness that the absorbance of Compound A at $\lambda_{max}$ was from 0.05 to 0.1). In the present invention, the K-value specified above was that obtained when poly(methyl methacrylate) with a number average molecular weight of 20,000 was used as polymer b.

Preferred examples of the polymers are those having the structures mentioned below.

(1) Water-insoluble and organic solvent-soluble homopolymers or copolymers composed of constitutional repeating units having a

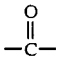

bond in the main chain or side chain thereof.

More preferably:

(2) Water-insoluble and organic solvent-soluble homopolymers or copolymers composed of constitutional repeating units having a

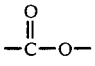

bond in the main chain or side chain thereof.

(3) Water-insoluble and organic solvent-soluble homopolymers or copolymers composed of constitutional repeating units having in the main chain or side chain thereof a

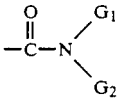

group where $G_1$ and $G_2$ each represents a hydrogen atom, or a substituted or unsubstituted alkyl or aryl group, provided that $G_1$ and $G_2$ must not be hydrogens at the same time.

Among the polymers (3), those in which one of $G_1$ and $G_2$ is a hydrogen atom and the other is a substituted or unsubstituted alkyl or aryl group having from 3 to 12 carbon atoms are especially preferred.

Specific examples of the polymers which may be used in the present invention are mentioned below, which, however, are not limitative.

(A) Vinyl Polymers:

As monomers for forming the vinyl polymers for use in the present invention, there are, for example, acrylic acid esters such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (number of mols added, n=9), 1-bromo-2-methoxyethyl acrylate and 1,1-dichloro-2-ethoxyethyl acrylate. In addition, the following monomers may also be used.

Methacrylic acid esters, specific examples of which include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)-ethyl methacrylate, ω-methoxypolyethylene glycol methacrylate (number of mols added, n=6), alkyl methacrylates and dimethylaminoethyl methacrylate methyl chloride salt.

Vinyl esters, specific examples of which include vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Acrylamides, for example, acrylamide, methyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxyethyl) acrylamide, diacetone acrylamide and tert-octyl acrylamide.

Methacrylamides, for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide and N-(2-acetoacetoxyethyl) methacrylamide.

Olefins, for example, dicyclopentadiene, ethylene, propylene, 1-butene, 1-pentene, vinyl chloride, vinylidene chloride, isoprene, chloroprene, butadiene and 2,3-dimethylbutadiene.

Styrene, for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate.

Vinyl ethers, for example, methyl vinyl ether, butyl vinyl ether, hexyl vinyl ether, methoxyethyl vinyl ether and dimethylaminoethyl vinyl ether.

In addition, there are butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylene malonenitrile and vinylidene.

Monomers which can be used for preparation of the polymers for use in the present invention (for example, the above-mentioned monomers) may be used in the form of a mixture of two or more monomers as comonomers, in accordance with various objects (for example, improvement of the solubility of the monomers). In addition, for the purpose of adjusting the coloring capacity or solubility of the polymers to be formed, acid group-containing monomers, for example, those mentioned below, can be used as comonomers, provided that the copolymers formed may not be soluble in water.

Such comonomers include acrylic acid; methacrylic acid; itaconic acid; maleic acid; monoalkyl itaconates, such as monomethyl itaconate, monoethyl itaconate, monobutyl itaconate; monoalkyl maleates, such as monomethyl maleate, monoethyl maleate, monobutyl maleate; citraconic acid; styrenesulfonic acid; vinylbenzylsulfonic acid; vinylsulfonic acid; acryloyloxyalkylsulfonic acids, such as acryloyloxymethylsulfonic acid, acryloyloxyethylsulfonic acid, acryloyloxypropylsulfonic acid; methacryloyloxyalkylsulfonic acids, such as methacryloyloxymethylsulfonic acid, methacryloyloxyethylsulfonic acid, methacryloyloxypropylsulfonic acid; acrylamidoalkylsulfonic acid, such as 2-acrylamido-2-methylethanesulfonic acid, 2-acrylamido-2-methylpropanesulfonic acid, 2-acrylamido-2-methylbutanesulfonic acid; methacrylamidoalkylsulfonic acids, such as 2-methacrylamido-2-methylethanesulfonic acid, 2-methacrylamido-2-methylpropanesulfonic acid, 2-methacrylamido-2-methylbutanesulfonic acid.

These acids may be in the form of a salt with an alkali metal (e.g., Na, K) or an ammonium ion.

When hydrophilic monomers (which are meant to form water-soluble homopolymers) among the above-mentioned vinyl monomers and other vinyl monomers which may be used in the present invention are used as comonomers, the proportion of the hydrophilic monomers in the resulting copolymers is not specifically limited, provided that the copolymers formed are not water-soluble. In general, the proportion is preferably 40 mol % or less, more preferably 20 mol % or less, especially preferably 10 mol % or less. When the hydrophilic comonomers to be copolymerized with the monomers of the invention have an acid group, the proportion of the acid group-containing comonomers in the copolymers formed is generally 20 mol % or less, preferably 10 mol % or less, and most preferably zero (that is, the copolymers formed do not contain such an acid group-containing comonomer), from the viewpoint of the aforesaid image storability of photographic materials having the copolymers.

Preferred monomers for forming the vinyl polymers for use in the present invention are methacrylate, acrylamide and methacrylamide monomers.

(B) Polymers Formed by Polycondensation and Addition Polymerization:

As polymers obtainable by polycondensation, polyesters obtained from polyhydric alcohols and polybasic acids as well as polyamides obtained from diamines, dibasic acids and ω-amino-ω-carboxylic acids are generally known. As polymers obtainable by addition polymerization, polyurethanes obtained from diisocyanates and dihydric alcohols are generally known.

As polyhydric alcohols, glycols having a structure of $HO—R_1—OH$ (where $R_1$ is a hydrocarbon chain, especially an aliphatic hydrocarbon chain, having from 2 to about 12 carbon atoms) or polyalkylene glycols are effective. As polybasic acids, compounds having a structure of $HOOC—R_2—COOH$ (where $R_2$ is a mere bond or a hydrocarbon chain having from 1 to about 12 carbon atoms) are effective.

As specific examples of polyhydric alcohols, there are ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythritol, mannitol and sorbitol.

As specific examples of polybasic acids, there are oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct, and rosin-maleic anhydride adduct.

As diamines, there are hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene and (4-aminophenyl)ether.

As ω-amino-ω-carboxylic acids, there are glycine, β-alanine, 3-aminopropanoic acid, 4-aminobutanoic acid, 5-aminopentanoic acid, 11-aminododecanoic acid, 4-aminobenzoic acid, 4-(2-aminoethyl)-benzoic acid and 4-(4-aminophenyl)butanoic acid.

As diisocyanates, there are ethylene diisocyanate, hexamethylene diisocyanate, m-phenylene diisocyanate, p-xylene diisocyanate and 1,5-naphthyl diisocyanate.

(C) Other Polymers:

As other polymers which may be used in the present invention, there are polyesters and polyamides obtained by ring-opening polymerization as described below.

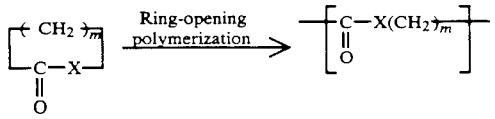

wherein X represents —O— or —NH—; m represents an integer of from 4 to 7; and $—(CH_2)_m—$ may be branched.

As examples of such monomers, there are β-propiolactone, ε-caprolactone, dimethylpropiolactone, α-pyrrolidone, α-piperidone, ε-caprolactam and α-methyl-ε-caprolactam.

The above-mentioned polymers for use in the present invention may be used in the form of a combination of two or more of them in accordance with the present invention.

The molecular weight and the polymerization degree of the polymers of the present invention does not have any substantially meaningful influence on the effect attainable by the invention. However, if the molecular weight of the polymer used is too large, there would be some problems in that a longer time would be necessary to dissolve the polymer in an auxiliary solvent and the polymer is hardly emulsified and dispersed because of the high viscosity of the polymer-containing solution so that coarse grains would often be formed in the resulting dispersion. As a result, the coloring capacity of the photographic material containing such a dispersion would be poor or the coating ability of such a dispersion-containing composition on a support would also be poor. If a large amount of an auxiliary solvent is used to lower the viscosity of the solution for the purpose of overcoming these problems, there would occur another problem in the manufacturing step of photographic materials. For these reasons, the viscosity of the polymers for use in the present invention is preferably 5,000 cps or less, more preferably 2,000 cps or less, when 30 g of a polymer is dissolved in 100 cc of an auxiliary solvent. In this connection, the molecular weight of the polymers for use in the present invention is preferably 150,000 or less, more preferably 100,000 or less.

The water-insoluble polymers as referred to in the present invention are those having a solubility of 3 g or less, preferably 1 g or less, in 100 g of distilled water.

The proportion of the polymer to the auxiliary solvent to be used therefor in accordance with the present invention varies depending upon the kind of the polymer used. Further, it varies in a broad range also depending upon the solubility of the polymer in the auxiliary solvent used, the polymerization degree of the polymer as well as the solubility of the couplers into the polymer. In general, the auxiliary solvent is used in a necessary amount that the solution obtained by dissolving at least three of a coupler, high boiling point coupler solvent and polymer in the auxiliary solvent may be sufficiently lower viscosity so that it may easily be dispersed in water or in an aqueous hydrophilic colloid solution. Since the viscosity of the solution would become higher with an increase of the polymerization degree of the polymer used, it would be difficult to indiscriminately determine the proportion of the polymer to the auxiliary solvent irrespective of the kind of the polymer. In general, the proportion is desirably from about 50/1 to about 1/50 (by weight). The proportion of the polymer of the invention to the coupler to be used is preferably from 1/20 to 20/1, more preferably from 1/10 to 10/1, by weight.

Specific examples of the polymers which may be used in the present invention will be mentioned below, which, however, are not limitative.

(P- 1) Polyvinyl acetate
(P- 2) Polyvinyl propionate
(P- 3) Polymethyl methacrylate
(P- 4) Polyethylene methacrylate
(P- 5) Polyethyl acrylate
(P- 6) Vinyl acetate-vinyl alcohol copolymer (95/5)
(P- 7) Poly-n-butyl acrylate
(P- 8) Poly-n-butyl methacrylate
(P- 9) Polyisobutyl methacrylate
(P- 10) Polyisopropyl methacrylate
(P- 11) Polydecyl methacrylate
(P- 12) n-Butyl acrylate-acrylamide copolymer (95/5)
(P- 13) Polymethyl chloroacrylate
(P- 14) 1,4-Butanediol-adipic acid polyester
(P- 15) Ethylene glycol-sebacic acid polyester
(P- 16) Polycaprolactone
(P- 17) Poly(2-tert-butylphenyl acrylate)
(P- 18) Poly(4-tert-butylphenyl acrylate)
(P- 19) n-Butyl methacrylate-N-vinyl-2-pyrrolidone copolymer (90/10)
(P- 20) Methyl methacrylate-vinyl chloride copolymer (70/30)
(P- 21) Methyl methacrylate-styrene copolymer (90/10)
(P- 22) Methyl methacrylate-ethyl acrylate copolymer (50/50)
(P- 23) n-Butyl methacrylate-methyl methacrylate-styrene copolymer (50/30/20)
(P- 24) Vinyl acetate-acrylamide copolymer (85/15)
(P- 25) Vinyl chloride-vinyl acetate copolymer (65/35)
(P- 26) Methyl methacrylate-acrylonitrile copolymer (65/35)
(P- 27) Diacetone acrylamide-methyl methacrylate copolymer (50/50)
(P- 28) Vinyl methyl ketone-isobutyl methacrylate copolymer (55/45)
(P- 29) Ethyl methacrylate-n-butyl acrylate copolymer (70/30)
(P- 30) Diacetone acrylamide-n-butyl acrylate copolymer (60/40)
(P- 31) Methyl methacrylate-cyclohexyl methacrylate copolymer (50/50)
(P- 32) n-Butyl acrylate-phenyl methacrylate-diacetone acrylamide copolymer (70/20/10)
(P- 33) N-tert-Butyl methacrylamide-methyl methacrylate-acrylic acid copolymer (60/30/10)
(P- 34) Methyl methacrylate-styrene-vinylsulfonamide copolymer (70/20/10)
(P- 35) Methyl methacrylate-phenyl vinyl ketone copolymer (70/30)
(P- 36) Butyl acrylate-methyl methacrylate-n-butyl methacrylate copolymer (35/35/30)
(P- 37) n-Butyl methacrylate-pentyl methacrylate-N-vinyl-2-pyrrolidone copolymer (38/38/24)
(P- 38) Methyl methacrylate-n-butyl methacrylate-isobutyl methacrylate-acrylic acid copolymer (37/29/25/9)
(P- 39) n-Butyl methacrylate-acrylic acid copolymer (95/5)
(P- 40) Methyl methacrylate-acrylic acid copolymer (95/5)
(P- 41) Benzyl methacrylate-acrylic acid copolymer (90/10)
(P- 42) n-Butyl methacrylate-methyl methacrylate-benzyl methacrylate-acrylic acid copolymer (35/35/25/5)
(P- 43) n-Butyl methacrylate-methyl methacrylate-benzyl methacrylate copolymer (35/35/30)
(P- 44) Poly-3-pentyl acrylate
(P- 45) Cyclohexyl methacrylate-methyl methacrylate-n-propyl methacrylate copolymer (37/29/34)
(P- 46) Polypentyl methacrylate
(P- 47) Methyl methacrylate-n-butyl methacrylate copolymer (65/35)
(P- 48) Vinyl acetate-vinyl propionate copolymer (75/25)
(P- 49) n-Butyl methacrylate-sodium 3-acryloxybutane-1-sulfonate copolymer (97/3)
(P- 50) n-Butyl methacrylate-methyl methacrylate-acrylamide copolymer (35/35/30)
(P- 51) n-Butyl methacrylate-methyl methacrylate-vinyl chloride copolymer (37/36/27)
(P- 52) n-Butyl methacrylate-styrene copolymer (90/10)
(P- 53) Methyl methacrylate-N-vinyl-2-pyrrolidone copolymer (90/10)
(P- 54) n-Butyl methacrylate-vinyl chloride copolymer (90/10)
(P- 55) n-Butyl methacrylate-styrene copolymer (70/30)
(P- 56) Poly(N-sec-butyl acrylamide)
(P- 57) Poly(N-tert-butyl acrylamide)
(P- 58) Diacetone acrylamide-methyl methacrylate copolymer (62/38)
(P- 59) Polycyclohexyl methacrylate-methyl methacrylate copolymer (60/40)
(P- 60) N-tert-Butyl acrylamide-methyl methacrylate copolymer (40/60)
(P- 61) Poly(N-n-butyl acrylamide)
(P- 62) Poly(tert-butyl methacrylate)-N-tert-butyl acrylamide copolymer (50/50)
(P- 63) tert-Butyl methacrylate-methyl methacrylate copolymer (70/30)
(P- 64) Poly(N-tert-butyl methacrylamide)
(P- 65) N-tert-butyl acrylamide-methyl methacrylate copolymer (60/40)
(P- 66) Methyl methacrylate-acrylonitrile copolymer (70/30)
(P- 67) Methyl methacrylate-vinyl methyl ketone copolymer (38/62)
(P- 68) Methyl methacrylate-styrene copolymer (75/25)
(P- 69) Methyl methacrylate-hexyl methacrylate copolymer (70/30)
(P- 70) Poly(benzyl acrylate)
(P- 71) Poly(4-biphenyl acrylate)
(P- 72) Poly(4-butoxycarbonylphenyl acrylate)
(P- 73) Poly(sec-butyl acrylate)
(P- 74) Poly(tert-butyl acrylate)
(P- 75) Poly[3-chloro-2,2-bis(chloromethyl)propyl acrylate]
(P- 76) Poly(2-chlorophenyl acrylate)
(P- 77) Poly(4-chlorophenyl acrylate)
(P- 78) Poly(pentachlorophenyl acrylate)
(P- 79) Poly(4-cyanobenzyl acrylate)
(P- 80) Poly(cyanoethyl acrylate)
(P- 81) Poly(4-cyanophenyl acrylate)

(P- 82) Poly(4-cyano-3-thiabutyl acrylate)
(P- 83) Poly(cyclohexyl acrylate)
(P- 84) Poly(2-ethoxycarbonylphenyl acrylate)
(P- 85) Poly(3-ethoxycarbonylphenyl acrylate)
(P- 86) Poly(4-ethoxycarbonylphenyl acrylate)
(P- 87) Poly(2-ethoxyethyl acrylate)
(P- 88) Poly(3-ethoxypropyl acrylate)
(P- 89) Poly(1H,1H,5H-octafluoropentyl acrylate)
(P- 90) Poly(heptyl acrylate)
(P- 91) Poly(hexadecyl acrylate)
(P- 92) Poly(hexyl acrylate)
(P- 93) Poly(isobutyl acrylate)
(P- 94) Poly(isopropyl acrylate)
(P- 95) Poly(3-methoxybutyl acrylate)
(P- 96) Poly(2-methoxycarbonylphenyl acrylate)
(P- 97) Poly(3-methoxycarbonylphenyl acrylate)
(P- 98) Poly(4-methoxycarbonylphenyl acrylate)
(P- 99) Poly(2-methoxyethyl acrylate)
(P-100) .Poly(4-methoxyphenyl acrylate)
(P-101) Poly(3-methoxypropyl acrylate)
(P-102) Poly(3,5-dimethyladamantyl acrylate)
(P-103) Poly(3-dimethylaminophenyl acrylate)
(P-104) Polyvinyl tert-butylate
(P-105) Poly(2-methylbutyl acrylate)
(P-106) Poly(3-methylbutyl acrylate)
(P-107) Poly(1,3-dimethylbutyl acrylate)
(P-108) Poly(2-methylpentyl acrylate)
(P-109) Poly(2-naphthyl acrylate)
(P-110) Poly(phenyl methacrylate)
(P-111) Poly(propylene acrylate)
(P-112) Poly(m-tolyl acrylate)
(P-113) Poly(o-tolyl acrylate)
(P-114) Poly(p-tolyl acrylate)
(P-115) Poly(N,N-dibutyl acrylamide)
(P-116) Poly(isohexyl acrylamide)
(P-117) Poly(isooctyl acrylamide)
(P-118) Poly(N-methyl-N-phenyl acrylamide)
(P-119) Poly(adamantyl methacrylate)
(P-120) Poly(benzyl methacrylate)
(P-121) Poly(2-bromoethyl methacrylate)
(P-122) Poly(2-N-tert-butylaminoethyl methacrylate)
(P-123) Poly(sec-butyl methacrylate)
(P-124) Poly(tert-butyl methacrylate)
(P-125) Poly(2-chloroethyl methacrylate)
(P-126) Poly(2-cyanoethyl methacrylate)
(P-127) Poly(2-cyanomethylphenyl methacrylate)
(P-128) Poly(4-cyanophenyl methacrylate)
(P-129) Poly(cyclohexyl methacrylate)
(P-130) Poly(dodecyl methacrylate)
(P-131) Poly(diethylaminoethyl methacrylate)
(P-132) Poly(2-ethylsulfinylethyl methacrylate)
(P-133) Poly(hexadecyl methacrylate)
(P-134) Poly(hexyl methacrylate)
(P-135) Poly(2-hydroxypropyl methacrylate)
(P-136) Poly(4-methoxycarbonylphenyl methacrylate)
(P-137) Poly(3,5-dimethyladamantyl methacrylate)
(P-138) Poly(dimethylaminoethyl methacrylate)
(P-139) Poly(3,3-dimethylbutyl methacrylate)
(P-140) Poly(3,3-dimethyl-2-butyl methacrylate)
(P-141) Poly(3,5,5-trimethylhexyl methacrylate)
(P-142) Poly(octadecyl methacrylate)
(P-143) Poly(tetradecyl methacrylate)
(P-144) Poly(4-butoxycarbonylphenyl methacrylamide)
(P-145) Poly(4-carboxyphenyl methacrylamide)
(P-146) Poly(4-ethoxycarbonylphenyl methacrylamide)
(P-147) Poly(4-methoxycarbonylphenyl methacrylamide)
(P-148) Poly(butylbutoxycarbonyl methacrylate)
(P-149) Poly(butyl chloroacrylate)
(P-150) Poly(butyl cyanoacrylate)
(P-151) Poly(cyclohexyl chloroacrylate)
(P-152) Poly(ethyl chloroacrylate)
(P-153) Poly(ethylethoxycarbonyl methacrylate)
(P-154) Poly(ethyl ethacrylate)
(P-155) Poly(ethyl fluoromethacrylate)
(P-156) Poly(hexyl hexyloxycarbonyl methacrylate)
(P-157) Poly(isobutyl chloroacrylate)
(P-158) Poly(isopropyl chloroacrylate)
(P-159) Trimethylenediamine glutaric acid polyamide
(P-160) Hexamethylenediamine-adipic acid polyamide
(P-161) Poly(2-pyrrolidone)
(P-162) Poly(ε-caprolactam)
(P-163) Hexamethylene diisocyanate-1,4-butanediol polyurethane
(P-164) p-Phenylene diisocyanate-ethylene glycol polyurethane The polymers for use in the present invention may be prepared, for example, as described below.

SYNTHESIS EXAMPLE 1

Synthesis of Polymethyl Methacrylate (P-3)

50.0 g of methyl methacrylate, 0.5 g of sodium polyacrylate and 200 ml of distilled water were placed in a 500-ml three-neck flask and heated to 80° C. with stirring in a nitrogen stream. 500 ml of dimethyl azobisisobutyrate was added as a polymerization initiator and polymerization was started.

After polymerization for 2 hours, the polymer liquid was cooled and 48.7 g of (P-3) (polymer beads) was obtained by filtering and washing with water.

SYNTHESIS EXAMPLE 2

Synthesis of Poly(N-tert-butyl Acrylamide) (P-57)

A mixture of 50.0 g of t-butyl acrylamide and 250 ml of toluene was placed in a 500-ml three-neck flask and heated to 80° C. with stirring in a nitrogen stream. 10 ml of a toluene solution containing 500 mg of azobisisobutyronitrile as a polymerization initiator was added to the mixture and polymerization was started.

After polymerization for 3 hours, the polymer liquid was cooled and poured into 1 liter of hexane. The solid that precipitated was filtered out and washed with hexane. This was dried by heating under reduced pressure to obtain 47.9 g of (P-57).

Next, specific examples of oil-soluble magenta couplers and yellow couplers which may be used in the present invention will be described below, which, however, are not limitative.

| Compound No. | $R_{33}$ | $R_{34}$ | $X_2$ |
|---|---|---|---|
| | | 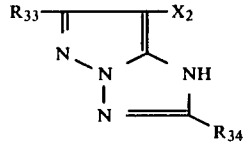 | |
| M-1 | $CH_3$— | 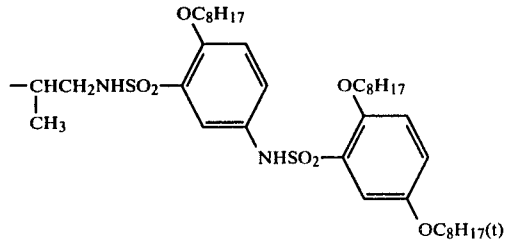 | Cl |
| M-2 | " | 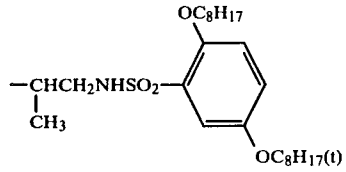 | " |
| M-3 | " | 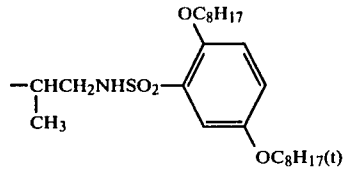 | 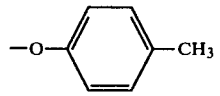 |
| M-4 | 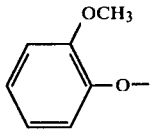 | 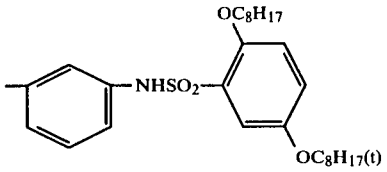 | 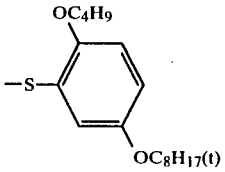 |

-continued
| Compound No. | $R_{33}$ | $R_{34}$ | $X_2$ |
|---|---|---|---|
| M-5 | $CH_3$— | 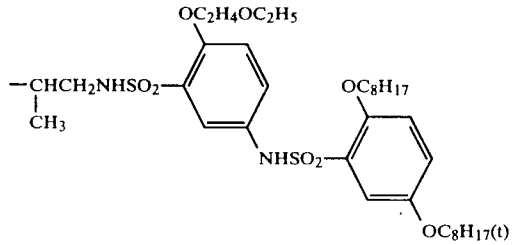 | Cl |
| M-6 | " | 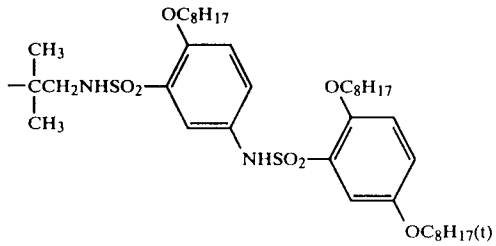 | " |
| M-7 | 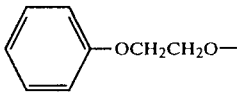 | 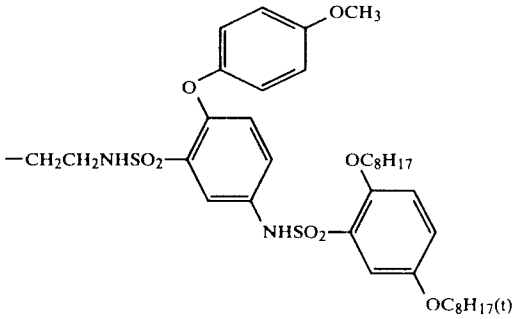 | 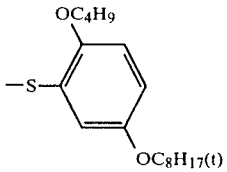 |
| M-8 | $CH_3CH_2O$— | " | " |

-continued
| Compound No. | $R_{33}$ | $R_{34}$ | $X_2$ |
|---|---|---|---|
| M-9 | 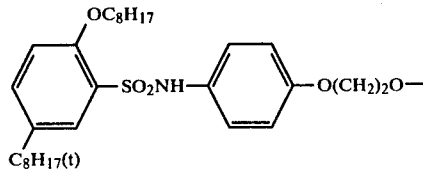 | 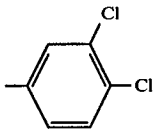 | 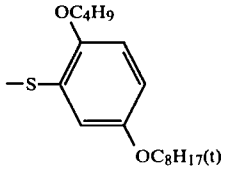 |
| M-10 | 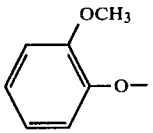 | 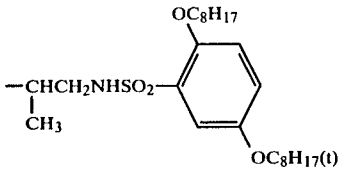 | Cl |
| | 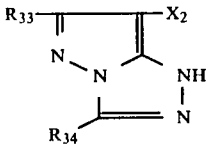 | | |
| M-11 | $CH_3$— | 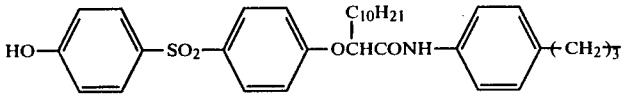 | Cl |
| M-12 | " | 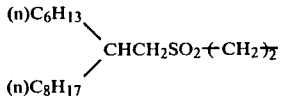 | " |
| M-13 | 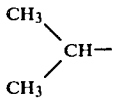 | 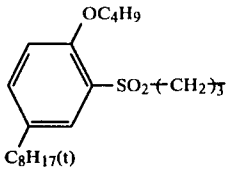 | Cl |

-continued
| Compound No. | $R_{33}$ | $R_{34}$ | $X_2$ |
|---|---|---|---|
| M-14 | $\leftarrow CH-CH_2 \rightarrow_{50} \leftarrow CH_2-C \rightarrow_{50}$ ($CH_3$; $COOCH_2CH_2OCH_3$; $CONH$) | $CH_3-CH-$ ($CH_2NHSO_2CH_3$) | " |
| M-15 | 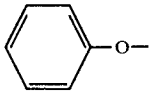 | 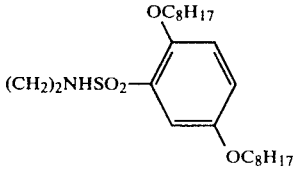 | Cl |
| M-16 | 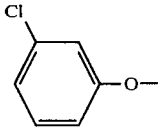 | 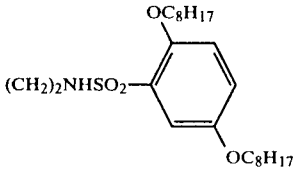 | 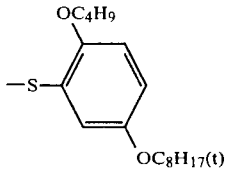 |

(M-17)
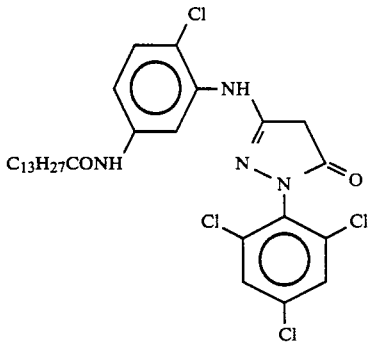
(M-18)
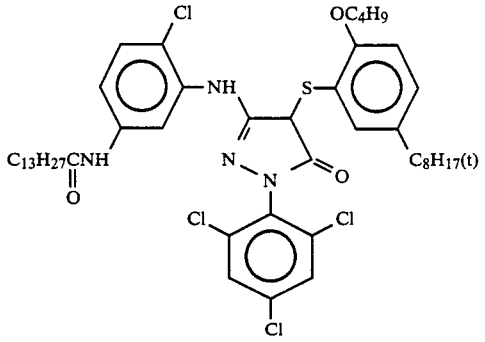
(M-19)
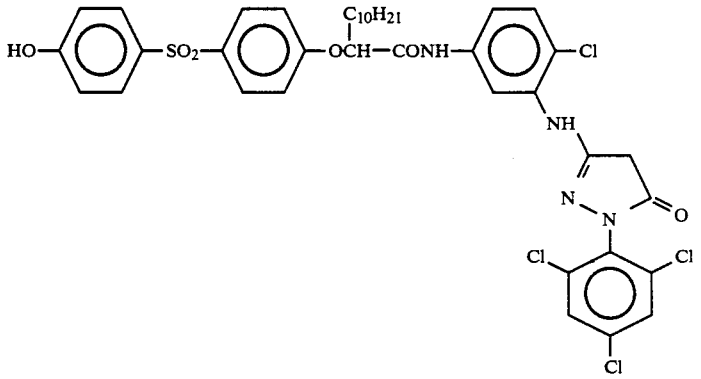
(M-20)
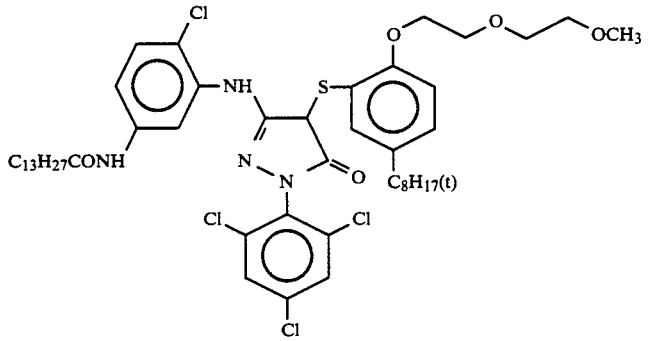

-continued
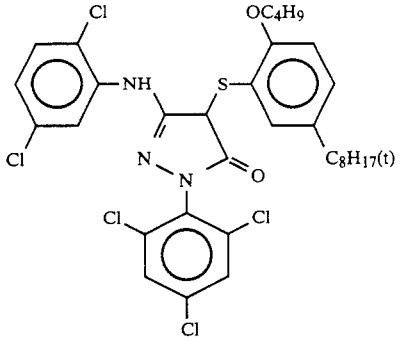
(M-21)
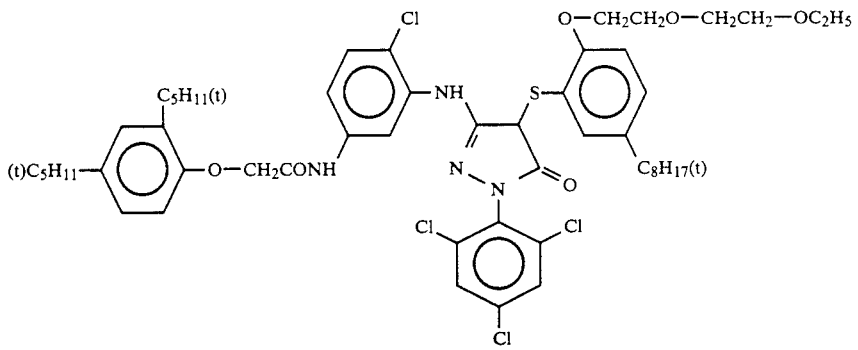
(M-22)
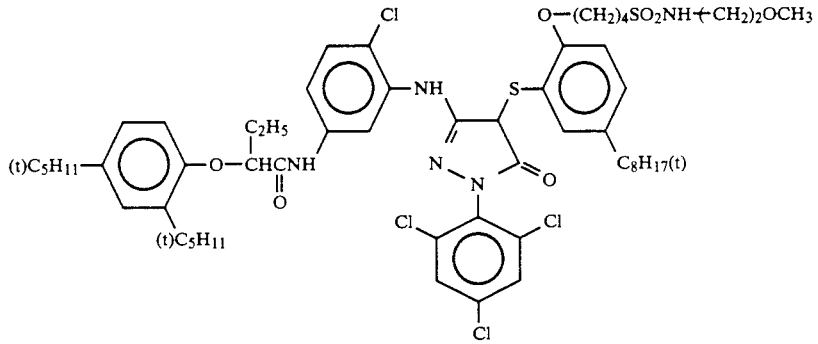
(M-23)
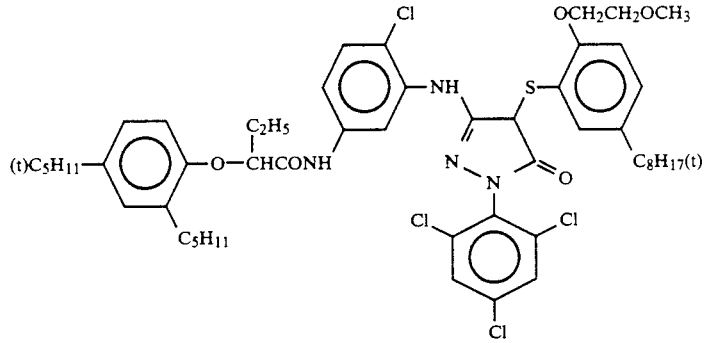
(M-24)

-continued
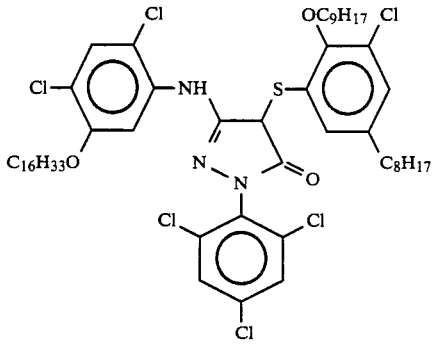
(M-25)
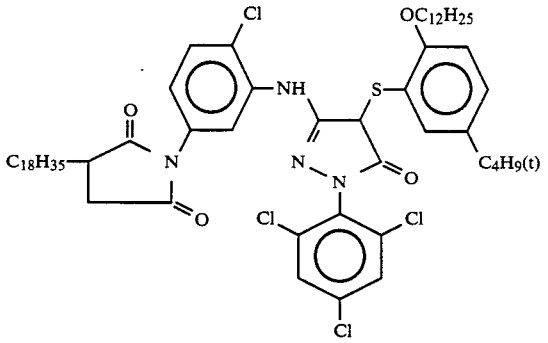
(M-26)
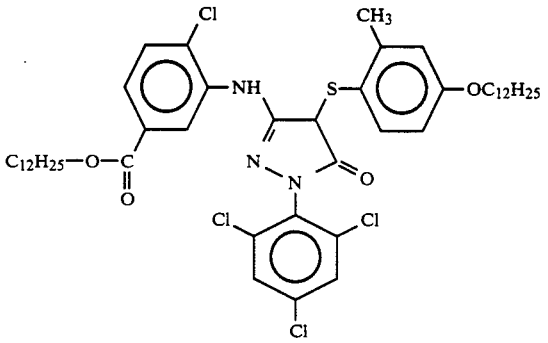
(M-27)
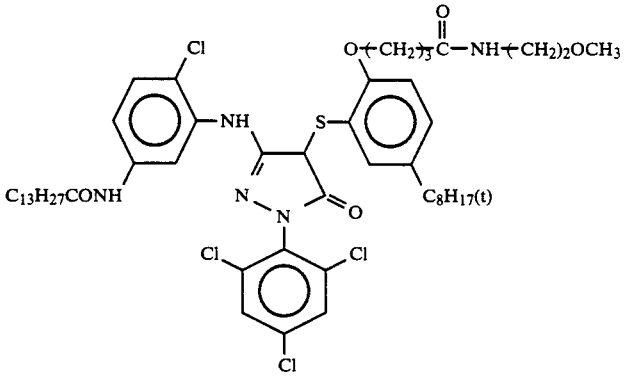
(M-28)

-continued
(M-29)
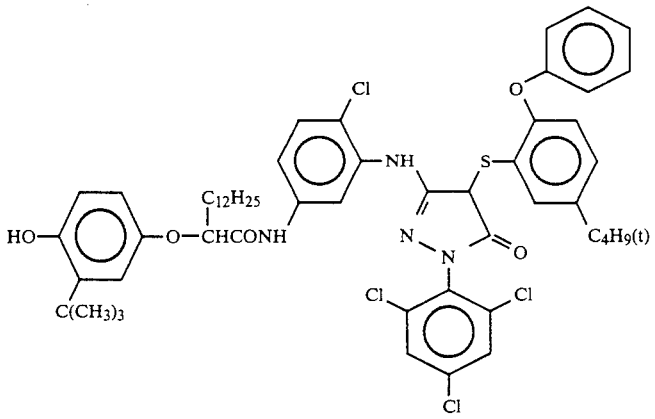
(M-30)
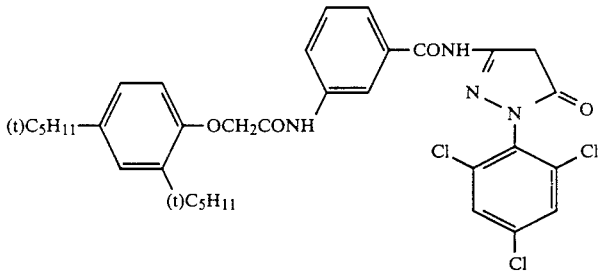
(M-31)
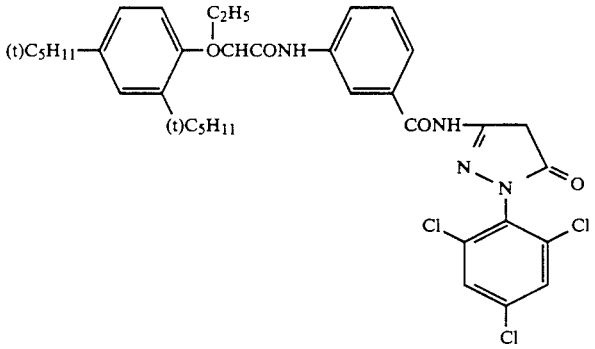
(M-32)
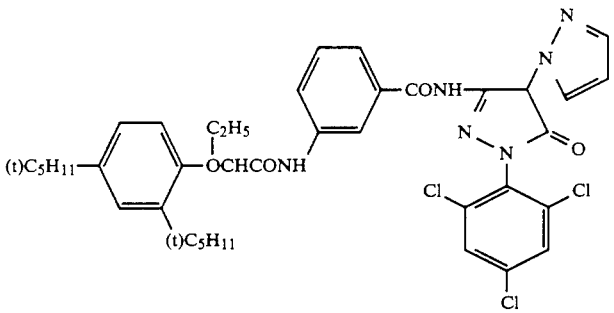

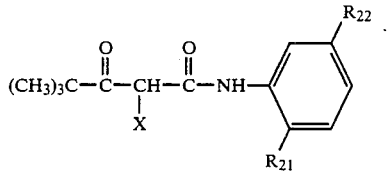
| Compound No. | $R_{22}$ | X | $R_{21}$ |
|---|---|---|---|
| Y-1 | $-COOCH(CH_3)COOC_{12}H_{25}$ | 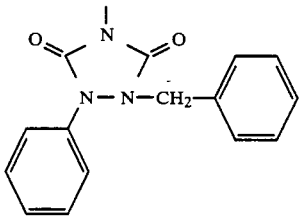 | Cl |
| Y-2 | $-COOCH(C_4H_9)COOC_{12}H_{25}$ | " | Cl |
| Y-3 | 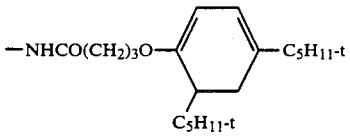 | 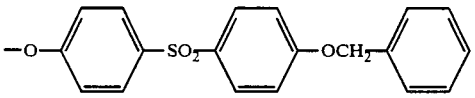 | Cl |
| Y-4 | " | 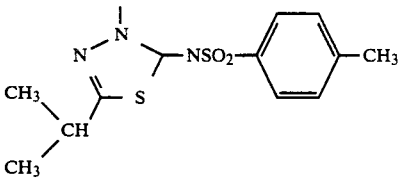 | Cl |
| Y-5 | " | 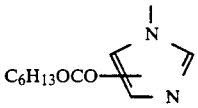 | Cl |
| Y-6 | $-NHSO_2C_{12}H_{25}$ | 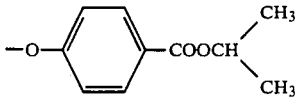 | Cl |
| Y-7 | $-NHSO_2C_{16}H_{33}$ | 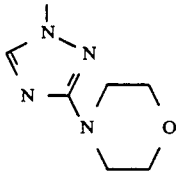 | Cl |
| Y-8 | $-COOC_{12}H_{25}(n)$ | 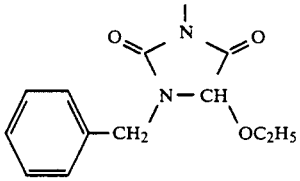 | Cl |

-continued
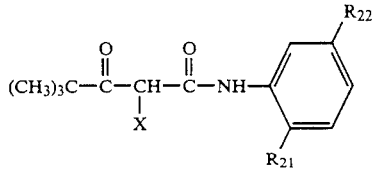
| Compound No. | $R_{22}$ | X | $R_{21}$ |
|---|---|---|---|
| Y-9 | 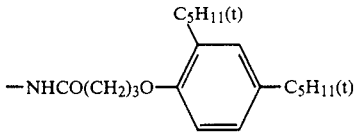 | 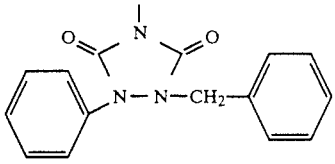 | Cl |
| Y-10 | 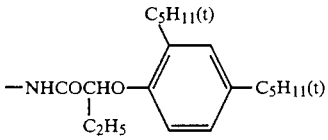 | 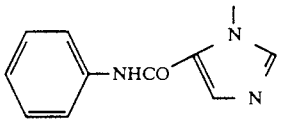 | $OCH_3$ |
| Y-11 | 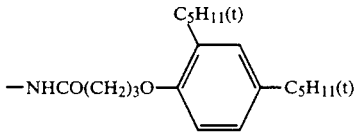 | 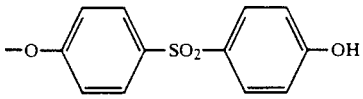 | Cl |
| Y-12 | 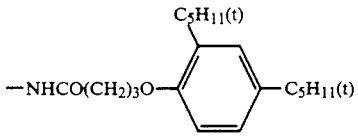 | 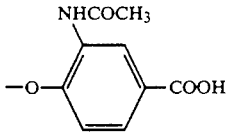 | Cl |
| Y-13 | 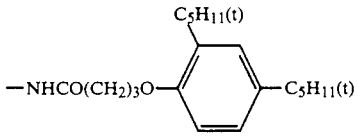 | 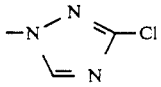 | Cl |
| Y-14 | 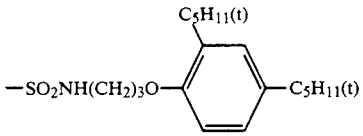 | 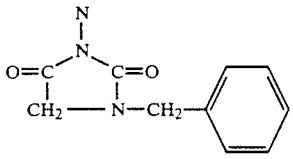 | Cl |
| Y-15 | 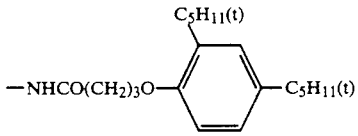 | 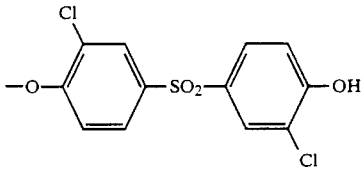 | Cl |
| Y-16 | 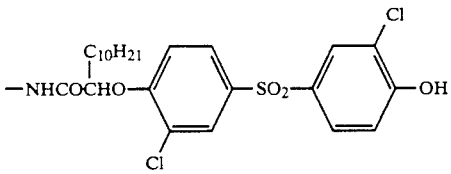 | 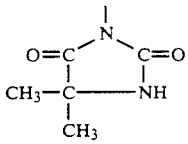 | Cl |

-continued
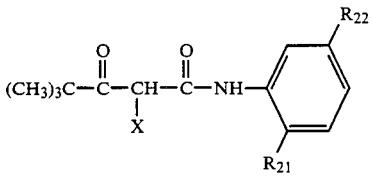
| Compound No. | $R_{22}$ | X | $R_{21}$ |
|---|---|---|---|
| Y-17 | 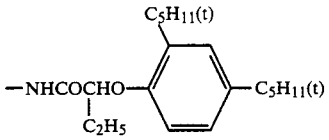 | 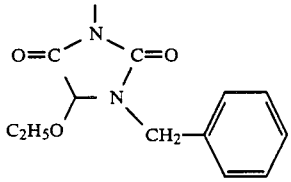 | Cl |
| Y-18 | 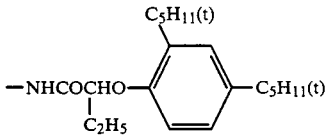 | 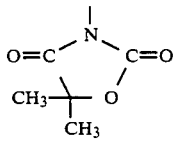 | Cl |
| Y-19 | $-NHSO_2C_{16}H_{33}$ | 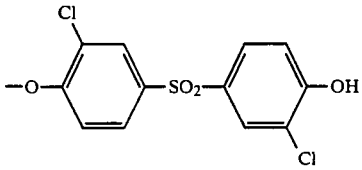 | Cl |
| Y-20 | 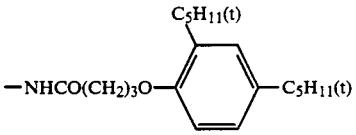 | 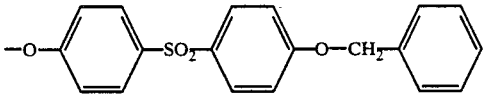 | Cl |
| Y-21 | 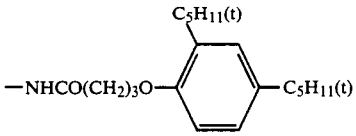 | 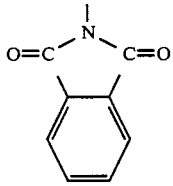 | Cl |
| Y-22 | 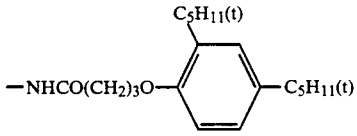 | 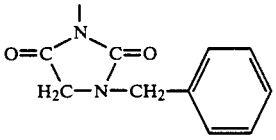 | Cl |
| Y-23 | 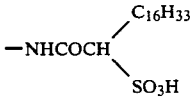 | 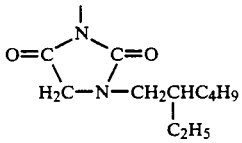 | Cl |
| Y-24 | 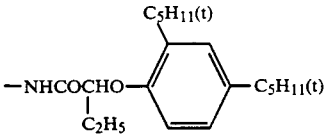 | 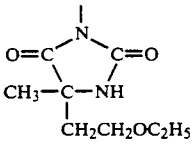 | Cl |

-continued
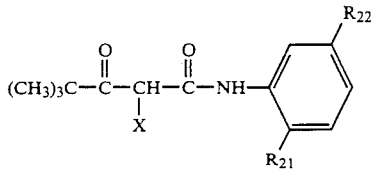
| Compound No. | $R_{22}$ | X | $R_{21}$ |
|---|---|---|---|
| Y-25 | $-NHCOCH(CH_3)CH_2SO_2C_{12}H_{25}(n)$ | 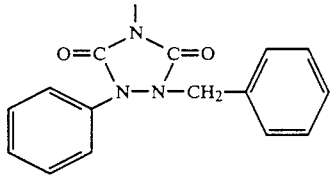 | Cl |
| Y-26 | $-NHSO_2C_{16}H_{33}(n)$ | 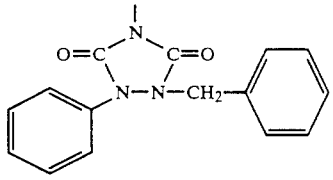 | Cl |
| Y-27 | 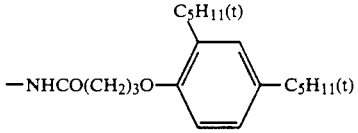 | 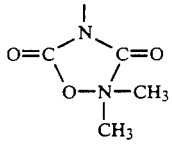 | Cl |
| Y-28 | " | 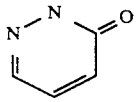 | Cl |
| Y-29 | " | 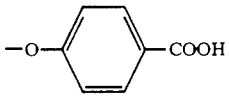 | Cl |
| Y-30 | $-NHSO_2-C_{16}H_{33}(n)$ | 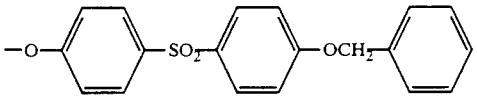 | Cl |
| Y-31 | " | 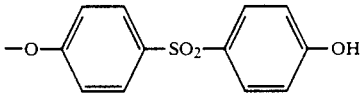 | Cl |
| Y-32 | $-SO_2-NHCH_3$ | 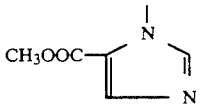 | $-OC_{16}H_{33}$ |
| Y-33 | 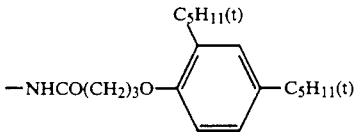 | 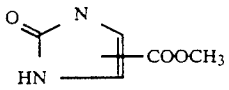 | Cl |

-continued

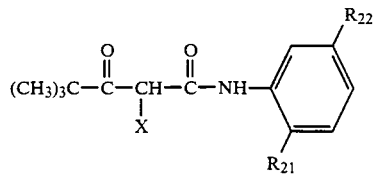

| Compound No. | $R_{22}$ | X | $R_{21}$ |
|---|---|---|---|
| Y-34 | $C_5H_{11}(t)$ 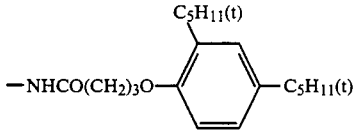 | $NHCOCH_3$ 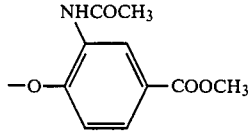 | Cl |
| Y-35 | 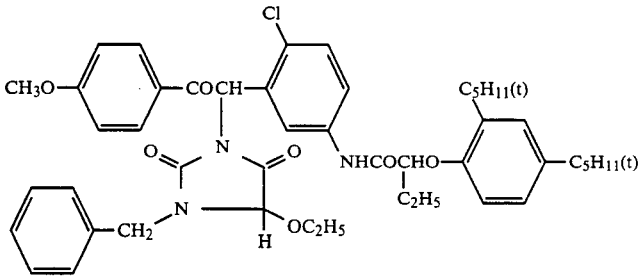 | | |

The dispersion of the fine oleophilic grains containing the coupler, high boiling point coupler solvent and polymer, which is used in accordance with the present invention, is prepared as described below.

The polymer of the present invention, which is a so-called linear polymer, as prepared by solution polymerization, emulsion polymerization or suspension polymerization and is not crosslinked, high boiling point coupler solvent, and coupler are all completely dissolved in an auxiliary organic solvent. Then, the resulting solution is dispersed in water, preferably in an aqueous hydrophilic colloid solution, more preferably in an aqueous gelatin solution, by the aid of a dispersing agent, ultrasonically or by means of a colloid mill, in the form of fine grains as dispersed. Next, the resulting dispersion is incorporated into a silver halide emulsion.

Alternatively, water or an aqueous hydrophilic colloid solution, such as an aqueous gelatin solution, may be added to an auxiliary organic solvent containing a dispersing agent, such as a surfactant, and the polymer, high boiling point coupler solvent and coupler of the invention to form an oil-in-water dispersion by phase inversion. From the thus-prepared dispersion, the auxiliary organic solvent may be removed by distillation, noodle washing or ultrafiltration. Then, the resulting dispersion may be blended with a photographic emulsion. The auxiliary organic solvent as used herein in accordance with the present invention is an organic solvent which is useful in emulsification and dispersion and is to be substantially finally removed from the photographic material in the drying step after coating or by the above-mentioned means. It is a low boiling point organic solvent which is soluble in water to some degree and which may be removed by washing with water. Examples of such auxiliary organic solvents include lower alkyl acetates, such as ethyl acetate or butyl acetate, as well as ethyl propionate, secondary butyl alcohol, methyl ethyl ketone, methyl isobutyl ketone, β-ethoxyethyl acetate, methyl cellosolve acetate and cyclohexanone.

In addition, an organic solvent which is completely miscible with water, for example, methyl alcohol, ethyl alcohol, acetone or tetrahydrofuran, may partly be used together with the said solvent, if desired.

These organic solvents may be used in combination of two or more kinds of them, if desired.

The fine oleophilic grains thus-obtained preferably have a mean grain size of from 0.04 μm to 2 μm, more preferably from 0.06 μm to 0.4 μm. The grain size of the fine oleophilic grains may be measured by a measuring apparatus of, for example, Nanonizer (by Coal Tar Co., England).

In accordance with the present invention, any one of silver bromide, silver iodobromide, silver iodochlorobromide, silver chlorobromide and silver chloride may be used as silver halides. In particular, when rapid processing is desired, silver chlorobromide containing 90 mol % or more, preferably 98 mol % or more, of silver chloride is preferred. The silver chlorobromide may contain a slight amount of silver iodide, but it is preferred to contain no silver iodide.

The mean grain size of the silver halide grains in the photographic emulsion of the photographic material of the present invention (the mean grain size is the mean value based on the projected area using the diameter of the grain as the grain size when the grain is spherical or approximately spherical, or using the edge length as the grain size when the grain is a cubic grain) is not specifically limitative but is preferably 2 μm or less, more preferably from 0.2 to 1.5 μm.

The silver halide grains in the photographic emulsion may have a regular crystal form such as a cubic, tetradecahedral or octahedral crystal form (that is, normal crystal emulsion), or may have an irregular crystal form such as a spherical or tabular crystal form, or may also have a composite form of these crystal forms. A mixture comprising grains of various crystal forms may also be used. Among them, the normal crystal emulsion is especially preferably used in the present invention.

In addition, a tabular grain silver halide emulsion, wherein tabular silver halide grains having an aspect ratio (diameter/thickness) of 5 or more account for 50% or more of the total projected area of the silver halide grains, may also be used.

The silver halide emulsion to be incorporated into at least one light-sensitive layer of the photographic material of the present invention is preferably a monodispersed emulsion having a variation coefficient (obtained by dividing the statistical standard deviation by the mean grain size and represented by percentage) of 15% or less, more preferably 10% or less.

The monodispersed emulsion may have the above variation coefficient by itself, but two or more monodispersed emulsions each having a different mean grain size, which have been separately prepared and which have a variation coefficient of 15% or less, preferably 10% less may be blended to prepare an emulsion for use in the present invention. The difference in the grain size as well as the proportion of the plural emulsions to be blended may freely be selected, but preferably, the difference in the mean grain size of the emulsions to be blended is selected from the range of from 0.2 μm to 1.0 μm.

For the definition of the variation coefficient and the method of measurement of the same, the description in T. H. James, *The Theory of the Photographic Process* (published by the Macmillan Company), 3rd Ed. (1966), page 39 may be referred to.

The silver halide grains may differ in the composition or phase between the inside and the surface layer thereof. In addition, the grains may be those which form a latent image mainly on the surface thereof, or those which form a latent image mainly in the inside thereof. The latter grains are especially useful as a direct positive emulsion.

The silver halide grains may be formed or physically ripened in the presence of a cadmium salt, a lead salt, a thallium salt, a lead salt, an iridium salt or a complex salt thereof, a rhodium salt or a complex salt thereof, an iron salt or a complex salt thereof.

The silver halide emulsions are generally chemically ripened. For chemical ripening, conventional means can be employed. The details of chemical ripening are described in JP-A-62-215272, from page 12, left lower column, line 18 to the same page, right lower column, line 16.

The silver halide emulsions are generally spectrally sensitized. For spectral sensitization, conventional methine dyes can be used. The details of spectral sensitization are described in JP-A-62-215272, from page 22, right upper column, line 3 from bottom to page 38 and its amendment filed on Mar. 16, 1987, sheet-B.

The photographic emulsions for use in the present invention can contain various compounds for the purpose of preventing fog during preparation, storage and photographic processing of the photographic materials and for the purpose of stabilizing the photographic property of the materials. For example, various compounds which are known as an antifoggant or stabilizer can be added for the purposes, which compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, aminotriazoles, benzotriazoles, nitrobenzotriazoles, mercaptotetrazoles (especially, 1-phenyl-5-mercaptotetrazole), mercaptopyrimidines, mercaptotriazines, etc.; thioketo compounds such as oxazolidonethione; azaindenes, such as triazaindenes, tetraazaindenes (especially, 4-hydroxy-substituted (1,3,3a,7)-tetraazaindene), pentaazaindenes, etc.; as well as benzenethiosulfonic acids, benzenesulfinic acids and benzenesulfonic acid amides.

The photographic materials of the present invention can contain, as a color fogging preventing agent or a color mixing preventing agent, hydroquinone derivatives, aminophenol derivatives, amines, gallic acid derivatives, catechol derivatives, ascorbic acid derivatives, colorless couplers, sulfonamidophenol derivatives and so on.

The photographic materials of the present invention can contain various antifading agents. For example, as organic antifading agents for cyan, magenta and/or yellow color images which may be used in the present invention, there may be typically mentioned hindered phenols such as hydroquinones, 6-hydroxychromans, 5-hydroxycoumarans, spirochromans, p-alkoxyphenols and bisphenols, as well as gallic acid derivatives, methylenedioxybenzenes, aminophenols and hindered amines and ether or ester derivatives thereof obtained by silylating or alkylating the phenolic hydroxyl group of the said compounds. In addition, metal complexes such as (bissalicylaldoximato)nickel complexes and (bis-N,N-dialkyldithiocarbamato)nickel complexes may also be used.

Specific examples of organic antifading agents which may be used in the present invention are mentioned in various patent publications, for example, as follows:

Hydroquinones are described in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; 6-hydroxychromans, 5-hydroxycoumarans and spirochromans are described in U.S. Pat. Nos. 3,432,300, 3,573,050, 3,574,627, 3,698,909 and 3,764,337 and JP-A-52-152225; spiroindanes are described in U.S. Pat. No. 4,360,589; p-alkoxyphenols are described in U.S. Pat. No. 2,735,765, British Patent 2,066,975, JP-A-59-10539 and JP-B-57-19764; hindered phenols are described in U.S. Pat. No. 3,700,455, JP-A-52-72225, U.S. Pat. No. 4,225,235 and JP-B-52-6623; gallic acid derivatives, methylenedihydroxybenzenes and aminophenols are described in U.S. Pat. Nos. 3,457,079 and 4,332,886 and JP-B-56-21144, respectively; hindered amines are described in U.S. Pat. Nos. 3,336,135 and 4,268,593, British Patents 1,326,889, 1,354,313 and 1,410,846, JP-B-51-1420, and JP-A-58-114036, JP-A-59-53846 and JP-A-59-78344; phenolic hydroxyl group-etherified or esterified derivatives are described in U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990 and JP-B-53-3263; and metal complexes are described in U.S. Pat. Nos. 4,050,938 and 4,241,155 and British Patent 2,027,731A. These compounds may be added to light-sensitive layers, as emulsified together with the corresponding color coupler, generally in an amount of from 5 to 100% by weight to the said coupler, whereby the intended object can be attained. In order to prevent the deterioration of cyan color images against heat and especially light, introduction of an ultraviolet absorber to both layers adjacent to the cyan coloring layer is more effective.

Among the aforesaid antifading agents, spiroindans and hindered amines are especially preferred.

The photographic materials of the present invention may contain an ultraviolet absorber in the hydrophilic colloid layer. For example, aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid esters (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455) may be used for the purpose. Ultraviolet absorbing couplers (for example, α-naphthol cyan dye-forming couplers) as well as ultraviolet absorbing polymers may also be used. The ultraviolet absorbers may be mordanted in a particular layer.

The photographic materials of the present invention can contain a water-soluble dye in the hydrophilic colloid layer, as a filter dye or for the purpose of anti-irradiation or for other various purposes. Such dyes include, for example, oxonol dyes, hemioxonol dyes, styryl dyes, merocyanine dyes, cyanine dyes and azo dyes. Above all, oxonol dyes, hemioxonol dyes and merocyanine dyes are especially useful. The details of useful oxonol dyes are described in JP-A-62-215272, from page 158, right upper column to page 163.

As the binder or protective colloid to be used in the emulsion layers of the photographic materials of the present invention, gelatin is advantageously used, but other hydrophilic colloids may also be used singly or in combination with gelatin.

The gelatin for use in the present invention may be either a lime-processed gelatin or an acid-processed gelatin. The details of preparation of gelatins are described in Arther Vais, *The Macromolecular Chemistry of Gelatin* (by Academic Press, 1964).

As the supports for the photographic materials of the present invention, any conventional ones which are generally used for conventional photographic materials may be used. For example, there are cellulose nitrate film, cellulose acetate film, cellulose acetate butyrate film, cellulose acetate propionate film, polystyrene film, polyethylene terephthalate film or polycarbonate film, and laminates thereof as well as thin glass film, paper and so on. Further, a paper coated or laminated with baryta or an α-olefin polymer, especially a polymer of an α-olefin having from 2 to 10 carbon atoms, such as polyethylene, polypropylene or ethylene-butene copolymer; a vinyl chloride resin containing a reflective material such as $TiO_2$; or a plastic film whose surface has been coarsened so as to elevate the adhesiveness with other polymer substances, as described in JP-B-47-19068 may also be used as a support, whereby a good effect can be obtained. In addition, an ultraviolet ray-hardening resin may also be used as a support.

The support may be selected to be a transparent or opaque one in accordance with the object of the photographic materials. In addition, a dye or pigment may be added to the support so as to color the same.

The opaque support includes paper which is naturally opaque and additionally an opaque film formed by adding a dye or a pigment such as titanium oxide to a transparent film, and a plastic film whose surface has been treated by the method described in JP-B-47-19068. The support generally has a subbing layer. In order to further improve the adhesibility, the surface of the support may be pretreated by corona discharge, ultraviolet irradiation or flame treatment.

The present invention may apply to general color photographic materials, for example, including color negative films, color papers, color reversal papers, color reversal films and so on, and especially preferably to printing color -photographic materials.

For development of the photographic materials of the present invention, black-and-white developers and/or color developers can be employed. The color developer for use in the present invention is preferably an aqueous alkaline solution consisting essentially of an aromatic primary amine color developing agent. As the color developing agent for the developer, p-phenylenediamine compounds are preferably used, although aminophenol compounds are useful. Specific examples of the compounds include 3-methyl-4-amino-N,N-diethylaniline, 3-methyl-4-amino-N-ethyl-N-β-hydroxyethylaniline, 3-methyl-4-amino-N-ethyl-β-methanesulfonamidoethylaniline, 3-methyl-4-amino-N-ethyl-N-β-methoxyethylaniline and sulfates, hydrochlorides and p-toluenesulfonates thereof. Two or more of these compounds may be used in combination in accordance with the object thereof.

The color developer generally contains a pH buffer such as alkali metal carbonates, borates or phosphates, and a development inhibitor or an antifoggant such as bromides, iodides, benzimidazoles, benzothiazoles or mercapto compounds. In addition, this may further contain, if desired, various kinds of preservatives, such as hydroxylamine, diethylhydroxylamine, sulfates, hydrazines, phenylsemicarbazides, triethanolamine, catecholsulfonic acids, triethylenediamine(1,4-diazabicyclo[2,2,2]octanes); an organic solvent such as ethylene glycol or diethylene glycol; a development accelerator such as benzyl alcohol, polyethylene glycol, quaternary ammonium salts or amines; a dye-forming coupler; a competing coupler; a foggant such as sodium boronhydride; an auxiliary developing agent such as 1-phenyl-3-pyrazolidone; a viscosity imparting agent; as well as various kinds of chelating agents such as aminopolycarboxylic acids, aminopolyphosphonic acids, alkylphosphonic acids or phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

When reversal processing is carried out, the photographic materials are first subjected to black-and-white development and then to color development. The black-and-white developer to be used in the black-and-white development may contain known black-and-white developing agents, for example, hydroxybenzenes such as hydroquinone, 3-pyrazolidones such as 1-phenyl-3-pyrazolidone or aminophenols such as N-methyl-p-aminophenol, singly or in combination thereof.

The color developer and black-and-white developer generally have a pH value of from 9 to 12. The amount of the replenisher to the developer, although depending upon the color photographic materials to be processed, is generally 3 liters or less per $m^2$ of the material. By lowering the bromide ion concentration in the replenisher, the amount may be 500 ml or lower. When the amount of the replenisher to be added is lowered, it is desired to prevent the evaporation and air oxidation of the processing solution by reducing the contact surface area of the processing tank with air. In addition, the amount of the replenisher to be added may also be reduced by means of suppressing accumulation of bromide ion in the developer.

After color is developed, the photographic emulsion layer is generally bleached. Bleaching may be carried out simultaneously with fixation (bleach-fixation) or separately from the latter. In order to accelerate the photographic processing, bleaching may be followed by bleach-fixation. In addition, bleach-fixation in continuous, two processing tanks, fixation prior to bleach-fixation or bleach-fixation followed by bleaching may also be applied to the photographic materials of the present invention in accordance with the object thereof. As the bleaching agent can be used, for example, compounds of polyvalent metals such as iron(III), cobalt(III), chromium(VI) or copper(II), as well as peracids, quinones and nitro compounds. Specific examples of the bleaching agent include ferricyanides; bichromates; organic complexes of iron(III) or cobalt(III), for example, complexes with aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, as well as with citric acid, tartaric acid or malic acid; persulfates; bromates; permanganates; and nitrobenzenes. Among them, aminopolycarboxylic acid/iron(III) complexes such as ethylenediaminetetraacetic acid/iron(III) complex as well as persulfates are preferred in view of the rapid processability thereof and of the prevention of environmental pollution. The aminopolycarboxylic acid/iron(III) complexes are especially useful both in a bleaching solution and in a bleach-fixing solution. The bleaching solution or bleach-fixing solution containing such aminopolycarboxylic acid/iron(III) complexes generally has a pH value of from 5.5 to 8, but the solution may have a lower pH value for rapid processing.

In the bleaching solution, bleach-fixing solution and the previous bath may contain a bleaching accelerating agent, if desired. Various bleaching accelerating agents are known, and examples of the agents which are advantageously used in the present invention include the mercapto group- or disulfide group-containing compounds described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426 and *Research Disclosure,* No. 17129 (July, 1978); the thiazolidine derivatives described in JP-A-50-140129; the thiourea derivatives described in JP-B-45-8506, JP-A-52-20832 and JP-A-53-32735 and U.S. Pat. No. 3,706,561; the iodides described in West German Patent 1,127,715 and JP-A-58-16235; the polyoxyethylene compounds described in West German Patents 966,410 and 2,748,430; the polyamine compounds described in JP-B-45-8836; the compounds described in JP-A-49-42434, JP-A-49-59644, JP-A-53-94927, JP-A-54-35727, JP-A-55-26506 and JP-A-58-163940; and bromide ion. Among them, the mercapto group- or disulfido group-containing compounds are preferred because of their accelerating effect, and in particular, the compounds described in U.S. Pat. No. 3,893,858, West German Patent 1,290,812 and JP-A-53-95630 are especially preferred. In addition, the compounds described in U.S. Pat. No. 4,552,834 are also preferred. These bleaching accelerating agents may also be added to photographic materials. When the color photographic materials are bleach-fixed, the bleaching accelerating agents are especially effective.

As the fixing agent, there are mentioned thiosulfates, thiocyanates, thioether compounds, thioureas and a large amount of iodides. Among them, thiosulfates are generally used, and in particular, ammonium thiosulfate is most widely used. As the preservative for the bleach-fixing solution, sulfites, bisulfites and carbonyl-bisulfite adducts are preferred.

The silver halide color photographic materials are generally rinsed in water and/or stabilized, after being desilvered. The amount of water to be used in the rinsing step can be set in a broad range in accordance with the characteristics of the photographic material being processed (for example, depending upon the raw material components, such as coupler and so on) or the use of the material, as well as the temperature of the rinsing water, the number of the rinsing tanks (the number of the rinsing stages), the replenishment system of normal current or countercurrent and other various kinds of conditions. Among these conditions, the relation between the number of the rinsing tanks and the amount of the rinsing water in a multistage counter-current rinsing system can be obtained by the method described in *Journal of the Society of Motion Picture and Television Engineers,* Vol. 64, pages 248 to 253 (May, 1955).

According to the multistage countercurrent system described in the above reference, the amount of the rinsing water to be used can be reduced noticeably, but because of the prolongation of the residence time of the water in the rinsing tank, bacteria would propogate in the tank so that the suspended matters generated by the propagation of bacteria would adhere to the surface of the material as being processed. Accordingly, this system would often have a problem. In the practice of processing the photographic materials of the present invention, the method of reducing calcium and magnesium ions, which is described in JP-A-62-288838, can extremely effectively be used for overcoming this problem. In addition, the isothiazolone compounds and thiabendazoles described in JP-A-57-8542; chlorine-containing bactericides, such as chlorinated sodium isocyanurates; and benzotriazoles and other bactericides described in H. Horiguchi, *Chemistry of Bactericidal and Fungicidal Agents,* and *Bactericidal and Fungicidal Techniques to Microorganisms,* edited by Association of Sanitary Technique, Japan, and *Encyclopedia of Bactericidal and Fungicidal Agents,* edited by Nippon Bactericide and Fungicide Association can also be used.

The pH value of the rinsing water to be used for processing the photographic materials of the present invention is from 4 to 9, preferably from 5 to 8. The temperature of the rinsing water and the rinsing time can also be set variously in accordance with the characteristics of the photographic material being processed as well as the use thereof. In general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, for example, as described in JP-A-57-8543, JP-A-58-14834 and JP-A-60-220345, can be employed.

In addition, the material can also be stabilized, following the rinsing step. As one example thereof, there may be mentioned a stabilizing bath containing formaldehyde and a surfactant, which is used as a final bath for color photographic materials. The stabilizing bath may also contain various chelating agents and fungicides.

The overflown solution from the rinsing and/or stabilizing solutions due to the addition of replenishers thereto may be reused in the other steps such as the preceding desilvering step.

The silver halide photographic materials of the present invention can contain a color developing agent for the purpose of simplifying and accelerating the processing of the materials. For incorporation of color developing agents into the photographic materials, various precursors of the agents are preferably used. For example, there are mentioned the indoaniline compounds described in U.S. Pat. No. 3,342,597, the Schiff base compounds described in U.S. Pat. No. 3,342,599 and *Research Disclosure,* No. 14850 and 15159, the aldol compounds described in *Research Disclosure,* No. 13924, the metal complexes described in U.S. Pat. No. 3,719,492 and the urethane compounds described in JP-A-53-135628, as the precursors.

The silver halide color photographic materials of the present invention can contain various kinds of 1-phenyl-3-pyrazolidones, if desired, for the purpose of accelerating the color developability thereof. Specific examples of the compounds are described in JP-A-56-64339, JP-A-57-144547 and JP-A-58-115438.

The processing solutions for the photographic materials of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solutions used. For the purpose of economization of silver in the photographic materials, the cobalt intensification or hydrogen peroxide intensification described in West German Patent 2,226,770 and U.S. Pat. No. 3,674,499 may be employed in processing the photographic materials of the invention.

The following examples are intended to illustrate the present invention in more detail but not to limit it in any way.

EXAMPLE 1

A multilayer silver halide photographic material (Sample No. 101) was prepared by forming the layers having the compositions mentioned below on a paper support, both surfaces of which were coated with polyethylene. The coupler solvent mentioned below contained ethyl acetate as an auxiliary solvent together with the high boiling point solvent.

Constitution of Layers

The compositions of the respective constitutional layers are mentioned below. The numeral for each component means the amount coated (g/m$^2$). The amount of silver halide coated is given in terms of the amount of silver therein.

Support

Polyethylene laminate paper (containing white pigment ($TiO_2$) and bluish dye (ultramarine) in polyethylene in the side of the first layer)

| | |
|---|---|
| First Layer: Blue-Sensitive Layer | |
| Monodispersed silver chlorobromide emulsion (EM1) (spectrally sensitized with sensitizing dye (ExS-1)) | 0.16 |
| Monodispersed silver chlorobromide emulsion (EM-2) (spectrally sensitized with sensitizing dye (ExS-1)) | 0.10 |
| Gelatin | 1.86 |
| Color image stabilizing agent (Cpd-1) | 0.02 |
| Yellow coupler (Y-17) | 0.83 |
| Solvent (mixture of Solv-1 and Solv-2 1/1 by volume) | 0.35 |
| Dispersing polymer (P-57) | 0.10 |
| Second Layer: Color Mixing Preventing Layer | |
| Gelatin | 0.99 |
| Color mixing preventing agent (Cpd-3) | 0.03 |
| Third Layer: Green-Sensitive Layer | |
| Monodispersed silver chlorobromide emulsion (EM3) (spectrally sensitized with sensitizing dye (ExS-2, ExS-3)) | 0.05 |
| Monodispersed silver chlorobromide emulsion (EM4) (spectrally sensitized with sensitizing dye (ExS-2, ExS-3)) | 0.11 |
| Gelatin | 1.80 |
| Magenta coupler (M-5) | 0.39 |
| Color image stabilizing agent (Cpd-4) | 0.20 |
| Color image stabilizing agent (Cpd-5) | 0.05 |
| Color image stabilizing agent (Cpd-6) | 0.04 |
| Solvent (Solv-3) | 0.12 |
| Solvent (Solv-4) | 0.25 |
| Fourth Layer: Ultraviolet Absorbing Layer | |
| Gelatin | 1.60 |
| Ultraviolet absorber (Cpd-7/Cpd-8/Cpd-9 = 3/2/6 by weight) | 0.70 |
| Color mixing preventing agent (Cpd-3) | 0.05 |
| Solvent (Solv-5) | 0.27 |
| Fifth Layer: Red-Sensitive Layer | |
| Monodispersed silver chlorobromide emulsion (EM5) (spectrally sensitized with sensitizing dye (ExS-4, ExS-5)) | 0.07 |
| Monodispersed silver chlorobromide emulsion (EM6) (spectrally sensitized with sensitizing dye (ExS-4, ExS-5)) | 0.16 |
| Gelatin | 0.92 |
| Cyan coupler (C-3) | 0.17 |
| Cyan coupler (C-11) | 0.15 |
| Color image stabilizing agent (Cpd-1) | 0.03 |
| Color image stabilizing agent (Cpd-5) | 0.01 |
| Color image stabilizing agent (Cpd-6) | 0.01 |
| Ultraviolet absorber (Cpd-7/Cpd-9/Cpd-10 = 3/4/2 by weight) | 0.17 |
| Solvent (Solv-3) | 0.20 |
| Sixth Layer: Ultraviolet Absorbing Layer | |
| Gelatin | 0.54 |
| Ultraviolet absorber (Cpd-7/Cpd-8/Cpd-9 = 1/5/3 by weight) | 0.21 |
| Color mixing preventing agent (Cpd-3) | 0.02 |
| Solvent (Solv-5) | 0.06 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

In addition, Cpd-11 and Cpd-12 were used as an anti-irradiation dye. Further, Alkanol XC (manufactured by DuPont Co.), sodium alkylbenzenesulfonate, succinic acid ester and Megafac F-120 (manufactured by Dai-Nippon Ink Co.) were incorporated in each layer as emulsification, dispersion and coating aids. Cpd-13 and Cpd-14 were used as a silver halide stabilizer.

In each layer, 1-hydroxy-3,5-dichloro-s-triazine sodium was used as a gelatin hardening agent an Cpd-2 as a viscosity increasing agent.

The details of the emulsions used are as follows.

| Emulsion | Shape | Mean Grain Size (μm) | Br Content (mol %) | Variation Coefficient |
|---|---|---|---|---|
| EM1 | Cubic | 0.96 | 80 | 0.06 |
| EM2 | Cubic | 0.64 | 80 | 0.07 |
| EM3 | Cubic | 0.52 | 70 | 0.08 |

-continued

| Emulsion | Shape | Mean Grain Size (μm) | Br Content (mol %) | Variation Coefficient |
|---|---|---|---|---|
| EM4 | Cubic | 0.40 | 70 | 0.09 |
| EM5 | Cubic | 0.44 | 70 | 0.09 |
| EM6 | Cubic | 0.36 | 70 | 0.08 |

$$\text{Variation Coefficient} = \frac{\text{Standard Deviation}}{\text{Mean Grain Size}}$$

The compounds used in the constitutional layers are as follows.

ExS-1

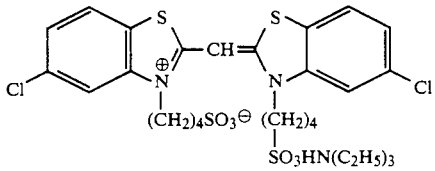

$6 \times 10^{-4}$ mol/Ag mol

ExS-2

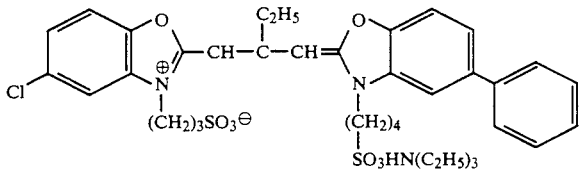

$4 \times 10^{-4}$ mol/Ag mol

ExS-3

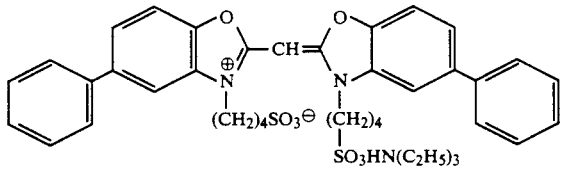

$8 \times 10^{-5}$ mol/Ag mol

ExS-4

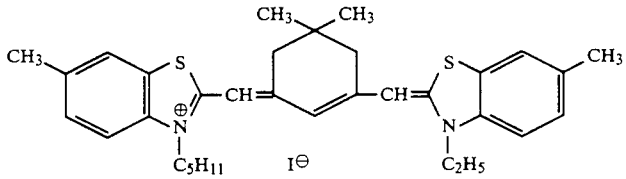

$1.8 \times 10^{-4}$ mol/Ag mol

ExS-5

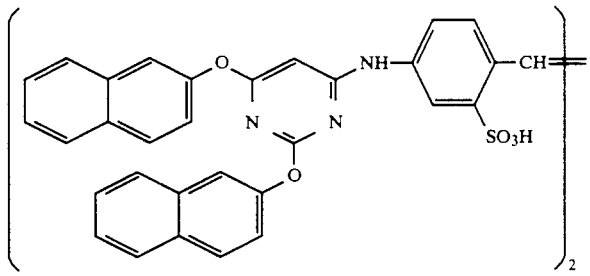

Cpd-1

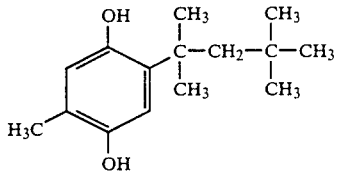

-continued
Cpd-2
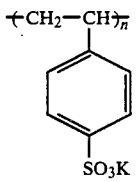
Cpd-3
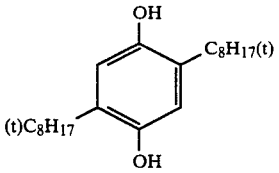
Cpd-4
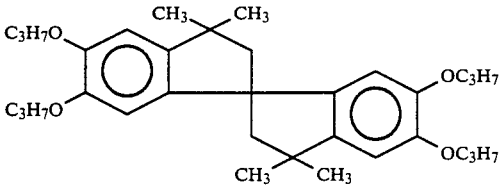
Cpd-5
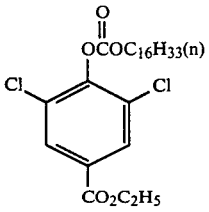
Cpd-6
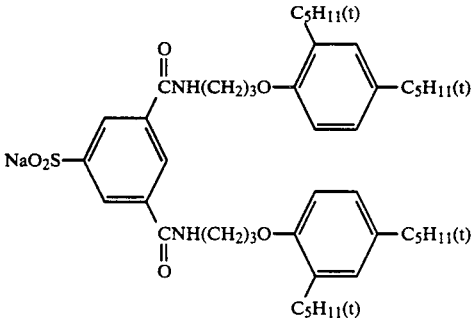
Cpd-7
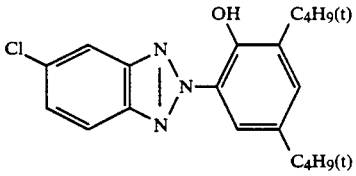
Cpd-8
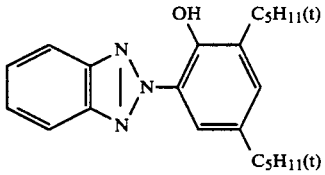
Cpd-9
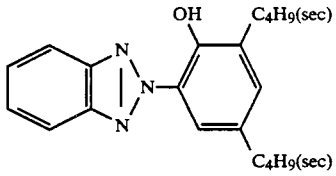

-continued

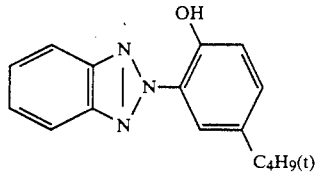

Cpd-10

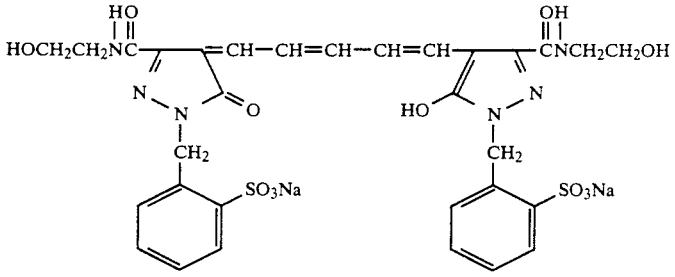

Cpd-11

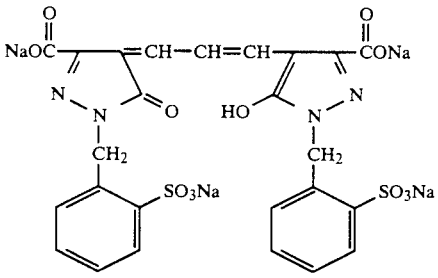

Cpd-12

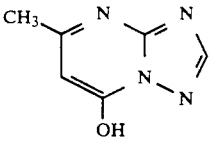

Cpd-13

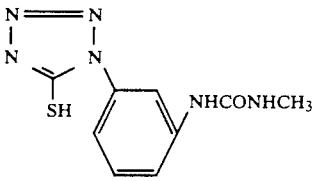

Cpd-14

$((iso)C_9H_{19}O)_3P{=}O$ Solv-1

$C_8H_{17}CHCH(CH_2)_7COOC_8H_{17}$ (O) Solv-2

Tricresyl Phosphate Solv-3

$(C_4H_9CHCH_2O)_2P{=}O$ ($C_2H_5$) Solv-4

$COOCH_2CH(C_2H_5)C_4H_9$ $(CH_2)_8$ $COOCH_2CH(C_2H_5)C_4H_9$ Solv-5

Sample Nos. 102 and 112 were prepared in the same manner as for Sample No. 101, except that the dispersing polymer and the coupler solvent in the red-sensitive layer were changed to those indicated in Table 1 below. (The coupler solvent was replaced by the same weight of that used in Sample No. 101, and the amount of the polymer was the same by weight as the coupler.)

Next, Sample Nos. 113 to 124 were prepared in the same manner as for Sample Nos. 101 to 112, respectively, except that only the coating composition of the red-sensitive layer was stored at 40° C. for 8 hours and then coated.

TABLE 1

| Sample No. | Cyan Coupler | Polymer | Coupler Solvent | Storage | Remarks |
|---|---|---|---|---|---|
| 101 | C-3/C-11 | — | Comparative A*1 | No storage | Comparison |
| 102 | C-3/C-11 | — | Comparative B*2 | " | " |
| 103 | C-3/C-11 | P-57 | — | " | " |
| 104 | C-3/C-11 | P-57 | Comparative A*1 | " | " |
| 105 | C-3/C-11 | P-57 | Comparative B*2 | " | " |
| 106 | C-3/C-11 | — | S-59 | " | " |
| 107 | C-3/C-11 | P-57 | S-59 | " | Invention |
| 108 | C-3/C-11 | P-57 | S-4 | " | " |
| 109 | C-3/C-11 | P-3 | S-4 | " | " |
| 110 | C-3/C-11 | P-110 | S-53 | " | " |
| 111 | C-3/C-11 | P-129 | S-63 | " | " |
| 112 | C-3/C-11 | P-57 | S-4/S-53 = 1/1*3 | " | " |
| 113 | | (Same as 101) | | Storage for 8 hours | Comparison |
| 114 | | (Same as 102) | | " | " |
| 115 | | (Same as 103) | | " | " |
| 116 | | (Same as 104) | | " | " |
| 117 | | (Same as 105) | | " | " |
| 118 | | (Same as 106) | | " | " |
| 119 | | (Same as 107) | | Storage for 8 hours | Invention |
| 120 | | (Same as 108) | | " | " |
| 121 | | (Same as 109) | | " | " |
| 122 | | (Same as 110) | | " | " |
| 123 | | (Same as 111) | | " | " |
| 124 | | (Same as 112) | | " | " |

*1Comparative A:

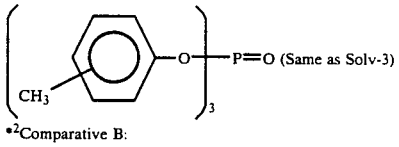

*2Comparative B:

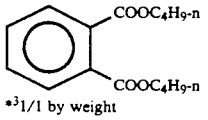

*3 1/1 by weight

The above-mentioned samples were imagewise exposed and then subjected to a running test, using a Fuji Color Paper Processing Apparatus PP600, in accordance with the processing procedure mentioned below. The running test was continued until the amount of the replenisher added reached two times of the tank capacity of the color developer tank.

| Processing Steps | Temperature (°C.) | Time | Amount of Replenisher* (ml) | Tank Capacity (liters) |
|---|---|---|---|---|
| Color Development | 38 | 1 min 40 sec | 290 | 17 |
| Bleach-Fixation | 33 | 60 sec | 150 | 9 |
| Rinsing (1) | 30 to 34 | 20 sec | — | 4 |
| Rinsing (2) | 30 to 34 | 20 sec | — | 4 |
| Rinsing (3) | 30 to 34 | 20 sec | 364 | 4 |
| Drying | 70 to 80 | 50 sec | | |

*Amount per $m^2$ of sample processed. (The rinsing was effected by a three tank countercurrent system from rinsing tank (3) to rinsing tank (1).)

The processing solutions used in the respective processing steps were as follows.

| | Tank Solution | Replenisher |
|---|---|---|
| Color Developer: | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Benzyl Alcohol | 16 ml | 22 ml |

-continued

| | Tank Solution | Replenisher |
|---|---|---|
| Diethylene Glycol | 10 ml | 10 ml |
| Sodium Sulfite | 2.0 g | 2.5 g |
| Potassium Bromide | 0.5 g | — |
| Potassium Carbonate | 30 g | 30 g |
| N-Ethyl-N-(β-methanesulfonamidoethyl)-3-methyl-4-aminoaniline Sulfate | 5.5 g | 7.5 g |
| Hydroxylamine Sulfate | 2.0 g | 2.5 g |
| Brightening Agent (WHITEX 4B, by Sumitomo Chemical) | 1.5 g | 1.5 g |
| Water to make | 1,000 ml | 1,000 ml |
| pH (25° C.) | 10.20 | 10.60 |
| Bleach-Fixing Solution: | | |
| Water | 400 ml | 400 ml |
| Ammonium Thiosulfate (70 wt %) | 200 ml | 300 ml |
| Sodium Sulfite | 20 g | 40 g |
| Ethylenediaminetetraacetic Acid Iron(III) Ammonium Complex | 60 g | 120 g |
| Disodium Ethylenediaminetetraacetate | 5 g | 10 g |
| Water to make | 1,000 ml | 1,000 ml |
| pH (25° C.) | 6.70 | 0.63 |

Rinsing Solution

Ion exchanged water (calcium, magnesium: each 3 ppm or less)

The thus processed samples were evaluated in accordance with the following methods (1) and (2).

Evaluation (1)

The difference in the sensitivity of the red-sensitive layer between the two samples (fresh sample and stored sample, for example, Sample No. 101 and Sample No. 113) was obtained. The amount of exposure necessary for giving a density of 0.5 was measured for both samples and was designated by EFr and E8hr, respectively. The difference ($\Delta E$) is given by the equation $\Delta E = \log[(-1/EFr) - (1/E8hr)]$. When the sensitivity was lowered (desensitized) after storage, the difference becomes a minus (−) value. Then, the stability of the coating composition after storage was obtained from the thus-calculated value. The results obtained were shown in Table 2. The maximum cyan density ($D^R_{max}$) was also shown therein.

TABLE 2

| Sample No. | Change in Sensitivity by Storage, ΔE | $D_{max}{}^R$ | Remarks |
|---|---|---|---|
| 101 | −0.25 | 2.58 | Comparison |
| (113) | | (2.58) | |
| 102 | −0.21 | 2.50 | " |
| (114) | | (2.50) | |
| 103 | −0.04 | 1.80 | " |
| (115) | | (1.79) | |
| 104 | −0.18 | 2.59 | " |
| (116) | | (2.60) | |
| 105 | −0.16 | 2.48 | " |
| (117) | | (2.48) | |
| 106 | −0.09 | 2.54 | " |
| (118) | | (2.54) | |
| 107 | −0.01 | 2.60 | Invention |
| (119) | | (2.60) | |
| 108 | −0.00 | 2.58 | " |
| (120) | | (2.57) | |
| 109 | −0.00 | 2.54 | " |
| (121) | | (2.54) | |
| 110 | −0.01 | 2.50 | " |
| (122) | | (2.50) | |
| 111 | −0.00 | 2.61 | " |
| (123) | | (2.61) | |
| 112 | −0.00 | 2.58 | " |
| (124) | | (2.58) | |

The results in Table 2 obviously indicate the superiority of the samples of the invention over the comparative samples. Precisely, in the samples of the invention, the change in the sensitivity (desensitization) of the stored coating compositions is small. Therefore, the coating compositions comprising the components as defined in accordance with the present invention were found to be excellent in the industrial producibility of photographic materials. Although the cause of the effect is not well understood, it is naturally presumed that the change (or deterioration) in coating compositions after being stored would be caused by the desorption of the sensitizing dye as adsorbed to the emulsion. As a result, the desorbed dye would form a salt together with the existing cyan coupler so that the dye is enveloped in the cyan coupler-containing fine oleophilic grains and the amount of the dye as adsorbed to the emulsion is thereby reduced. Under the situation, it is presumed that the amount of the sensitizing dye as captured by the cyan coupler would be reduced because of the combination of the polymer and coupler of the invention. As a result, the change in the sensitivity (desensitization) would be small in accordance with the present invention. In addition, it is further noted from Table 2 above that the cyan density of Sample Nos. 103 (and 115) having no coupler solvent was lower than the other samples having the coupler solvent. From this fact, the advantage of the present invention is further noticeable.

Evaluation (2)

Sample Nos. 101 to 102 were stored under the condition of 100° C. for 8 days, under the conditions of 80° C.. and relative humidity 70% for 10 days, or under the condition of irradiation by xenon fade meter (85,000 lux) for 8 days. The decrease of the cyan density from the initial density 1.5 was measured. The results are shown in Table 3 below.

In addition, the yellow density and the magenta density were also measured in the same manner. As a result, the decrease fell within the range indicated in Table 4 below.

TABLE 3

| Sample No. | Layer | Color Image Fastness: 100° C., 8 Days (%) | 80° C., 70% RH, 10 Days (%) | Xenon Irradiation, 8 Days (%) | Remarks |
|---|---|---|---|---|---|
| 101 | R | 40 | 16 | 34 | Comparison |
| 102 | R | 43 | 18 | 36 | " |
| 103 | R | 18 | 6 | 45 | " |
| 104 | R | 18 | 9 | 25 | " |
| 105 | R | 19 | 9 | 27 | " |
| 106 | R | 39 | 16 | 37 | " |
| 107 | R | 17 | 7 | 20 | Invention |
| 108 | R | 18 | 8 | 20 | " |
| 109 | R | 20 | 10 | 22 | " |
| 110 | R | 16 | 7 | 19 | " |
| 111 | R | 13 | 6 | 16 | " |
| 112 | R | 16 | 7 | 19 | " |

TABLE 4

| Sample No. | Layer | 100° C., 8 Days (%) | 80° C., 70% RH, 10 Days (%) | Xenon Irradiation, 8 Days (%) |
|---|---|---|---|---|
| 101 | B | 4–6 | 3–4 | 16–18 |
| 112 | G | 3–5 | 2–5 | 16–18 |

As is obvious from the results in Tables 3 and 4, all of the samples of the present invention were superior to any other comparative samples in the color image fastness and in the fading balance between yellow and magenta colors. In addition, it is also noted that the sample containing no coupler solvent was poor in the light fastness. In the samples prepared by the use of the coupler solvent of the invention, the stain in the white background part was less than other comparative coupler-containing samples in all of the storing conditions tested. Accordingly, it is obvious that the samples of the invention are superior to any other comparative samples in terms of total image storability.

EXAMPLE 2

A multilayer silver halide photographic material (Sample No. 201) was prepared by forming the layers having the compositions mentioned below on a paper support, both surfaces of which were coated with polyethylene.

Constitution of Layers

The compositions of the respective constitutional layers are mentioned below. The numeral for each component means the amount coated (g/m²). The amount of silver halide coated is given in terms of the amount of silver therein.

Support:

Polyethylene laminate paper (containing white pigment ($TiO_2$) and bluish dye (ultramarine)in polyethylene in the side of the first layer)

| | |
|---|---|
| First Layer: Blue-Sensitive Layer | |
| Monodispersed silver chlorobromide emulsion (EM7) (spectrally sensitized with sensitizing dye (ExS-7)) | 0.27 |
| Gelatin | 1.86 |
| Yellow coupler (Y-17) | 0.82 |
| Solvent (Solv-6) | 0.35 |
| Second Layer: Color Mixing Preventing Layer | |
| Gelatin | 0.99 |
| Color mixing preventing agent (Cpd-3) | 0.06 |
| Solvent (Solv-3) | 0.12 |
| Third Layer: Green-Sensitive Layer | |
| Mondispersed silver chlorobromide emulsion (EM8) (spectrally sensitized with sensitizing dye (ExS-3, ExS-6)) | 0.45 |
| Gelatin | 1.24 |
| Magenta coupler | 0.35 |
| Color image stabilizer (Cpd-4) | 0.12 |
| Color image stabilizer (Cpd-15) | 0.06 |
| Color image stabilizer (Cpd-16) | 0.10 |
| Color image stabilizer (Cpd-17) | 0.01 |
| Solvent (Solv-3) | 0.25 |
| Solvent (Solv-4) | 0.25 |
| Fourth Layer: Ultraviolet Absorbing Layer | |
| Gelatin | 1.60 |
| Ultraviolet absorber (Cpd-7/Cpd-9/Cpd-19 = 3/2/6 by weight) | 0.70 |
| Color mixing preventing agent (Cpd-3) | 0.05 |
| Solvent (Solv-7) | 0.42 |
| Fifth Layer: Red-Sensitive Layer | |
| Monodispersed silver chlorobromide emulsion (EM9) (spectrally sensitized with sensitizing dye (ExS-4, ExS-5)) | 0.20 |
| Gelatin | 0.92 |
| Cyan coupler (C-1) | 0.15 |
| Cyan coupler (C-14) | 0.18 |

-continued

| | |
|---|---|
| Color image stabilizer (Cpd-1) | |
| Ultraviolet absorber (Cpd-7/Cpd-9/Cpd-19 = 3/4/2 by weight) | 0.17 |
| Solvent (Solv-6) | 0.20 |
| Sixth Layer: Ultraviolet Absorbing Layer | |
| Gelatin | 0.54 |
| Ultraviolet absorber (Cpd-7/Cpd-9/Cpd-17 = 1/5/3 by weight) | 0.21 |
| Solvent (Solv-7) | 0.08 |
| Seventh Layer: Protective Layer | |
| Acid-processed gelatin | 1.33 |
| Acryl-modified copolymer of polyvinyl alcohol (modification degree 17%) | 0.17 |
| Liquid paraffin | 0.03 |

In addition, Cpd-11 and Cpd-12 were used as an anti-irradiation dye. Further, Alkanol XC (manufactured by DuPont Co.), sodium alkylbenzenesulfonate, succinic acid ester and Megafac F-120 (manufactured by Dai-Nippon Ink Co.) were incorporated in each layer as emulsification, dispersion and coating aids. Cpd-13 and Cpd-14 were used as a silver halide stabilizer.

In each layer, 1-hydroxy-3,5-dichloro-s-triazine sodium salt was used as a gelatin hardening agent and Cpd-2 as a viscosity increasing agent.

The details of the emulsions used are as follows.

| Emulsion | Shape | Mean Grain Size (μm) | Br Content (%) | Variation Coefficient |
|---|---|---|---|---|
| EM7 | Cubic | 0.85 | 0.6 | 0.10 |
| EM8 | Cubic | 0.45 | 1.00 | 0.09 |
| EM9 | Cubic | 0.31 | 1.8 | 0.10 |

$$\text{Variation Coefficient} = \frac{\text{Standard Deviation}}{\text{Mean Grain Size}}$$

The compounds used in the constitutional layers are as follows.

ExS-6

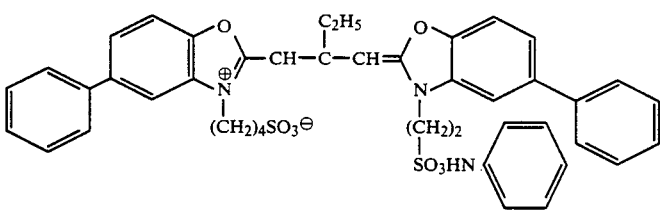

ExS-7

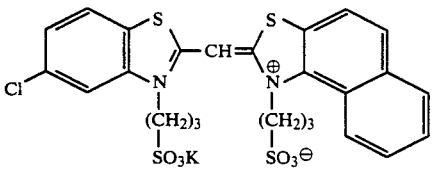

Cpd-15

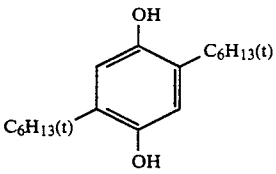

-continued

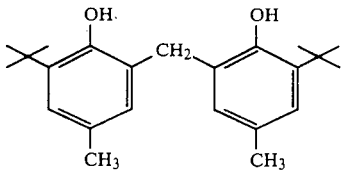

Cpd-16

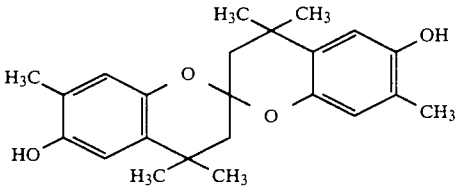

Cpd-17

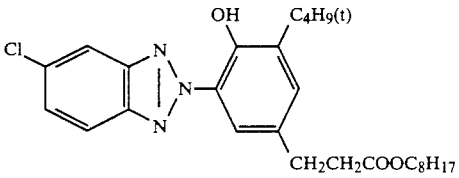

Cpd-18

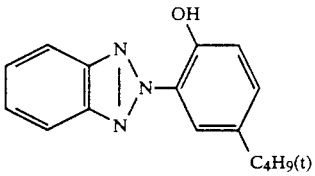

Cpd-19

| | |
|---|---|
| Dibutyl Phthalate | Solv-6 |
| Dioctyl Sebacate | Solv-7 |

Sample Nos. 202 and 212 were prepared in the same manner as for Sample No. 201, except that the dispersing polymer and the coupler solvent in the red-sensitive layer were changed to those indicated in Table 5 below. (The coupler solvent was replaced by the same weight of that used in Sample No. 201, and the amount of the polymer was the same by weight as in the coupler.)

Next, Sample Nos. 213 to 224 were prepared in the same manner as for Sample Nos. 201 to 212, respectively, except that only the coating composition for the red-sensitive layer was stored at 40° C. for 6 hours and then coated.

TABLE 5

| Sample No. | Cyan Coupler | Polymer | Coupler Solvent | Storage | Remarks |
|---|---|---|---|---|---|
| 201 | C-1/C-14 | — | Comparative B*1 | No storage | Comparison |
| 202 | C-1/C-14 | — | Comparative C*2 | " | " |
| 203 | C-1/C-14 | P-57 | — | " | " |
| 204 | C-1/C-14 | P-57 | Comparative B*1 | " | " |
| 205 | C-1/C-14 | P-57 | Comparative C*2 | " | " |
| 206 | C-1/C-14 | — | S-4 | " | " |
| 207 | C-1/C-14 | P-57 | S-4 | " | Invention |
| 208 | C-1/C-14 | P-57 | S-5 | " | " |
| 209 | C-1/C-14 | P-129 | S-5 | " | " |
| 210 | C-1/C-14 | P-27 | S-50 | " | " |
| 211 | C-3 | P-57 | S-63 | " | " |
| 212 | C-1 | P-64 | S-4/S-45*3 | " | " |
| 213 | | (Same as 201) | | Storage for 6 hours | Comparison |
| 214 | | (Same as 202) | | " | " |
| 215 | | (Same as 203) | | " | " |
| 216 | | (Same as 204) | | " | " |
| 217 | | (Same as 205) | | " | " |
| 218 | | (Same as 206) | | " | " |
| 219 | | (Same as 207) | | Storage for 6 hours | Invention |
| 220 | | (Same as 208) | | " | " |
| 221 | | (Same as 209) | | " | " |
| 222 | | (Same as 210) | | " | " |
| 223 | | (Same as 211) | | " | " |

TABLE 5-continued

| Sample No. | Cyan Coupler | Polymer | Coupler Solvent | Storage | Remarks |
|---|---|---|---|---|---|
| 224 | | (Same as 212) | | " | " |

*1Comparative B:

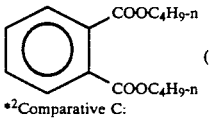

(Same as Solv-6)

*2Comparative C:

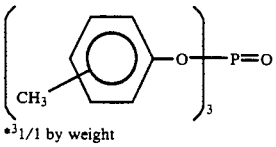

*3 1/1 by weight

The above-mentioned samples were wedgewise exposed through an optical wedge and then processed in accordance with the procedure mentioned below.

| Processing Steps | Temperature (°C.) | Time (sec) |
|---|---|---|
| Color Development | 35 | 45 |
| Bleach-Fixation | 30–36 | 45 |
| Stabilization (1) | 30–37 | 20 |
| Stabilization (2) | 30–37 | 20 |
| Stabilization (3) | 30–37 | 20 |
| Stabilization (4) | 30–37 | 30 |
| Drying | 70–85 | 60 |

(The stabilizers was effected by a four-tank counter-current system from stabilization tank (4) to stabilization tank (1).)

The processing solutions used in the respective processing steps were as follows.

| | |
|---|---|
| Color Developer: | |
| Water | 800 ml |
| Ethylenediaminetetraacetic Acid | 2.0 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Brightening Agent (4,4'-diaminostilbene compound) | 2.0 g |
| Water to make | 1,000 ml |
| pH (25° C.) | 10.10 |
| Bleach-Fixing Solution: | |
| Water | 400 ml |
| Ammonium Thiosulfate (70 wt %) | 100 ml |
| Sodium Sulfite | 18 g |
| Ethylenediaminetetraacetic Acid Iron(III) Ammonium Complex | 55 g |
| Disodium Ethylenediaminetetraacetate | 3 g |
| Glacial Acetic Acid | 8 g |
| Water to make | 1,000 ml |
| pH (25° C.) | 5.5 |
| Stabilizing Solution: | |
| Formaldehyde (37 wt %) | 0.1 g |
| Formalin-Sulfite Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1,000 ml |
| pH (25° C.) | 4.0 |

Next, in the same manner as for Evaluation (1) in Example 1, the value of $\Delta E = \log[(1/EFr) - (1/E6hr)]$ was obtained in each sample, and the time dependent stability (storage stability) of the coating composition in each sample was thereby measured. The results obtained are shown in Table 6 below.

TABLE 6

| Sample No. | Change in Sensitivity by Storage, ΔE | Remarks |
|---|---|---|
| 201 (213) | −0.32 | Comparison |
| 202 (214) | −0.34 | " |
| 203 (215) | −0.08 | " |
| 204 (216) | −0.16 | " |
| 205 (217) | −0.18 | " |
| 206 (218) | −0.21 | " |
| 207 (219) | −0.01 | Invention |
| 208 (220) | −0.02 | " |
| 209 (221) | −0.01 | " |
| 210 (222) | −0.02 | " |
| 211 (223) | −0.01 | " |
| 212 (224) | −0.03 | " |

As is obvious from Table 6 above, the same results as in Example 1 were obtained. In addition, the coloring capacity and the color image fastness were also evaluated in the same manner as in Example 1, and the same results as in Example 1 were also obtained.

In accordance with the present invention, the time dependent stability (storage stability) of the coating compositions for preparing photographic materials has been improved and, further, not only the fastness of the color images formed has been improved but, also, the stain in the photographic materials processed has been reduced.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a silver halide emulsion on a support, wherein said layer contains a dispersion of fine oleophilic grains, which grains contain at least one nondiffusible oil-soluble cyan coupler capable of forming a substantially nondiffusible dye by coupling with the oxidation product of an aromatic primary amine developing agent and at least one coupler solvent which is immiscible with water and has no aromatic group in the molecule and which has a melting point of 100° C. or lower and has a boiling point or decomposition point of 140° C. or higher and which is represented by one of the following formulae (III), (IV) or (VI), wherein the dispersion of said fine oleophilic grains is one obtained by emulsifying and dispersing a solution comprising at least one of said coupler, at least one of said coupler solvent and at least one water-insoluble and organic solvent-soluble homopolymer or copolymer having a Tg of at least 60° C.:

$$L_1—(COOR_7)_n \quad (III)$$

$$L_2—(OCOR_8)_m \quad (IV)$$

wherein $R_7$ and $R_8$ each represents an aliphatic group; $L_1$ and $L_2$ each represents a 2-valent to 4-valent aliphatic group; n and m each represents an integer of from 2 to 4; and $R_7$ and $R_8$ may be the same or different;

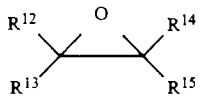
(VI)

wherein $R^{12}$, $R^{13}$, $R^{14}$ and $R^{15}$ each represents an alkyl or substituted alkyl group having from 1 to 40 carbon atoms, an alkoxycarbonyl or substituted alkoxycarbonyl group having from 1 to 40 carbon atoms, or a hydrogen atom, provided that all of $R^{12}$, $R^{13}$, $R^{14}$ and $R^{15}$ are not hydrogen atoms at the same time; and $R^{12}$, $R^{13}$, $R^{14}$ and $R^{15}$ may be the same or different and they may form rings.

2. The silver halide color photographic material as in claim 1, wherein the cyan coupler is represented by the following general formula (I) or (II):

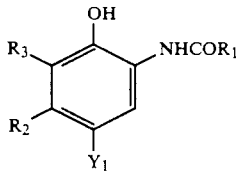
(I)

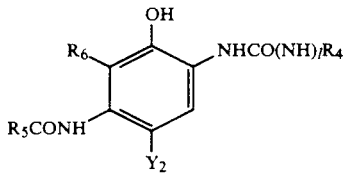
(II)

wherein $R_1$, $R_4$ and $R_5$ each represents a substituted or unsubstituted aliphatic, aromatic or heterocyclic group; $R_3$ and $R_6$ each represents a hydrogen atom, a halogen atom, an aliphatic group, an aromatic group or an acylamino group; or $R_6$ is a nonmetallic atomic group necessary for forming a nitrogen-containing 5-membered to 7-membered ring together with $R_5$; $R_2$ represents a substituted or unsubstituted aliphatic group; $Y_1$ and $Y_2$ each represents a hydrogen atom or a group or atom capable of being released in an oxidative coupling reaction with a developing agent; l represents 0 or 1; and one of the groups $R_2$, $R_3$ and $Y_1$ or one of the groups $R_5$, $R_6$ and $Y_2$ may form a dimer or polymer coupler.

3. The silver halide color photographic material as in claim 1, wherein the polymer is a water-insoluble and organic solvent-soluble homopolymer or copolymer composed of constitutional repeating units having a

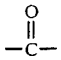

bond in the main chain or side chain thereof.

4. The silver halide color photographic material as in claim 2, wherein the polymer is a water-insoluble and organic solvent-soluble homopolymer or copolymer composed of constitutional repeating units having a

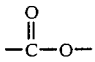

bond in the main chain or side chain thereof.

5. The silver halide color photographic material as in claim 3, wherein the polymer is a water-soluble and organic solvent-soluble homopolymer or copolymer composed of constitutional repeating units having in the side chain thereof a

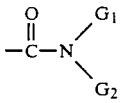

group wherein $G_1$ and $G_2$ each represents a hydrogen atom, or a substituted or unsubstituted alkyl or aryl group, provided that both $G_1$ and $G_2$ are not hydrogen atoms at the same time.

6. The silver halide color photographic material as in claim 1, wherein said cyan coupler is employed in an amount of from 1/10 to 1 mol per mol of silver halide.

7. The silver halide color photographic material as in claim 1, wherein the ratio of said coupler solvent to coupler is from 0.1 to 3 times by weight of the coupler.

8. The silver halide color photographic material as in claim 7, wherein the ratio of said coupler solvent to coupler is from 0.3 to 2 times by weight of the coupler.

9. The silver halide color photographic material as in claim 1, wherein an auxiliary solvent is present in the material and the ratio of said polymer to said auxiliary solvent is 50/1 to 1/50 by weight.

10. The silver halide color photographic material as in claim 1, wherein the ratio of said polymer to said coupler is 1/20 to 20/1 by weight.

11. The silver halide color photographic material as in claim 10, wherein the ratio of said polymer to said coupler is 1/10 to 10/1 by weight.

12. The silver halide color photographic material as in claim 2, wherein the coupler is a compound of formula (I), the coupler solvent is a compound of formula (III) and the polymer is a water-insoluble and organic solvent-soluble homopolymer or copolymer composed of constitutional repeating units having a

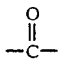

bond in the main chain or side chain thereof.

13. The silver halide color photographic material as in claim 2, wherein the coupler is a compound of formula (I), the coupler solvent is a compound of formula (III) and the polymer is a water-soluble and organic solvent-soluble homopolymer or copolymer composed of constitutional repeating units having in the side chain thereof a

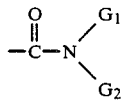

group wherein $G_1$ and $G_2$ each represents a hydrogen atom, or a substituted or unsubstituted alkyl or aryl group, provided that both $G_1$ and $G_2$ are not hydrogen atoms at the same time.

* * * * *